US010034103B2

(12) United States Patent
Puria

(10) Patent No.: US 10,034,103 B2
(45) Date of Patent: Jul. 24, 2018

(54) HIGH FIDELITY AND REDUCED FEEDBACK CONTACT HEARING APPARATUS AND METHODS

(71) Applicant: EARLENS CORPORATION, Menlo Park, CA (US)

(72) Inventor: Sunil Puria, Sunnyvale, CA (US)

(73) Assignee: Earlens Corporation, Menlo Park, CA (US)

( * ) Notice: Subject to any disclaimer, the term of this patent is extended or adjusted under 35 U.S.C. 154(b) by 0 days.

(21) Appl. No.: 14/661,832

(22) Filed: Mar. 18, 2015

(65) Prior Publication Data

US 2015/0271609 A1 Sep. 24, 2015

Related U.S. Application Data

(60) Provisional application No. 61/955,016, filed on Mar. 18, 2014.

(51) Int. Cl.
*H04R 25/00* (2006.01)
*H04R 23/00* (2006.01)

(52) U.S. Cl.
CPC ..... *H04R 25/456* (2013.01); *H04R 23/008* (2013.01); *H04R 25/305* (2013.01);
(Continued)

(58) Field of Classification Search
CPC .. H04R 25/652; H04R 25/658; H04R 25/606; H04R 25/554; H04R 23/006;
(Continued)

(56) References Cited

U.S. PATENT DOCUMENTS 3,209,082 A 9/1965 McCarrell et al.
3,229,049 A 1/1966 Goldberg
(Continued)

FOREIGN PATENT DOCUMENTS

AU 2004301961 A1 2/2005
DE 2044870 A1 3/1972
(Continued)

OTHER PUBLICATIONS

Carlile, et al. Frequency bandwidth and multi-talker environments. Audio Engineering Society Convention 120. Audio Engineering Society, May 20-23, 2006. Paris, France. 118:8 pages.
(Continued)

*Primary Examiner* — Davetta W Goins
*Assistant Examiner* — Phylesha Dabney
(74) *Attorney, Agent, or Firm* — Wilson Sonsini Goodrich and Rosati, P.C.

(57) ABSTRACT

An output transducer is coupled to a support structure, and the support structure configured to contact one or more of the tympanic membrane, an ossicle, the oval window or the round window. An input transducer is configured for placement near an ear canal opening to receive high frequency localization cues. A sound inhibiting structure, such as an acoustic resistor or a screen, may be positioned at a location along the ear canal between the tympanic membrane and the input transducer to inhibit feedback. A channel can be coupled to the sound or feedback inhibiting structure to provide a desired frequency response profile of the sound or feedback inhibiting structure.

10 Claims, 8 Drawing Sheets

(52) U.S. Cl.
CPC ..... *H04R 25/606* (2013.01); *H04R 2225/021* (2013.01); *H04R 2225/025* (2013.01)

(58) Field of Classification Search
CPC .. H04R 25/405; H04R 25/407; H04R 25/453; H04R 25/43; H04R 1/265; H04R 25/40; H04R 3/04; H04R 25/456; B29C 70/58; B29C 70/66; A61F 11/08; G10K 11/002
USPC ..... 381/312, 313, 315, 317, 318, 322, 325, 381/326, 328, 60; 29/896.21; 600/25, 600/559, 558; 607/57; 435/6.15
See application file for complete search history.

(56) References Cited

U.S. PATENT DOCUMENTS 3,440,314 A 4/1969 Eldon
3,549,818 A 12/1970 Justin
3,585,416 A 6/1971 Mellen
3,594,514 A 7/1971 Wingrove
3,710,399 A 1/1973 Hurst
3,712,962 A 1/1973 Epley
3,764,748 A 10/1973 Branch et al.
3,808,179 A 4/1974 Gaylord
3,882,285 A 5/1975 Nunley et al.
3,965,430 A 6/1976 Brandt
3,985,977 A 10/1976 Beaty et al.
4,002,897 A 1/1977 Kleinman et al.
4,031,318 A 6/1977 Pitre
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch
4,303,772 A 12/1981 Novicky
4,319,359 A 3/1982 Wolf
4,334,315 A 6/1982 Ono et al.
4,334,321 A 6/1982 Edelman
4,338,929 A 7/1982 Lundin et al.
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion et al.
4,606,329 A 8/1986 Hough
4,611,598 A 9/1986 Hortmann et al.
4,628,907 A 12/1986 Epley
4,641,377 A 2/1987 Rush et al.
4,654,554 A 3/1987 Kishi
4,689,819 A 8/1987 Killion
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,759,070 A * 7/1988 Voroba ..... A61B 5/12 381/328
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,870,688 A 9/1989 Voroba et al.
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,963,963 A 10/1990 Dorman
4,999,819 A 3/1991 Newnham et al.
5,003,608 A 3/1991 Carlson
5,012,520 A 4/1991 Steeger
5,015,224 A 5/1991 Maniglia
5,015,225 A 5/1991 Hough et al.
5,031,219 A 7/1991 Ward et al.
5,061,282 A 10/1991 Jacobs
5,066,091 A 11/1991 Stoy et al.
5,068,902 A * 11/1991 Ward ..... B29C 70/58 181/130
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A 1/1994 Leysieffer et al.
5,282,858 A 2/1994 Bisch et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,572,594 A 11/1996 Devoe et al.
5,606,621 A 2/1997 Reiter et al.
5,624,376 A 4/1997 Ball et al.
5,654,530 A 8/1997 Sauer et al.
5,692,059 A 11/1997 Kruger
5,699,809 A * 12/1997 Combs ..... G01H 15/00 600/558
5,701,348 A * 12/1997 Shennib ..... H04R 25/456 381/322
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Mueller et al.
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,868,682 A * 2/1999 Combs ..... G01H 15/00 600/559
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia

(56) References Cited

U.S. PATENT DOCUMENTS 5,913,815 A 6/1999 Ball et al.
5,922,077 A 7/1999 Espy et al.
5,940,519 A 8/1999 Kuo
5,949,895 A 9/1999 Ball et al.
5,984,859 A 11/1999 Lesinski
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,135,612 A 10/2000 Clore
6,137,889 A 10/2000 Shennib et al.
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy
6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,259,951 B1 7/2001 Kuzma et al.
6,261,224 B1 7/2001 Adams et al.
6,264,603 B1 7/2001 Kennedy
6,277,148 B1 8/2001 Dormer
6,312,959 B1 11/2001 Datskos
6,339,648 B1 1/2002 McIntosh et al.
6,354,990 B1 3/2002 Juneau et al.
6,359,993 B2 * 3/2002 Brimhall ..... H04R 25/456 381/322
6,366,863 B1 4/2002 Bye et al.
6,385,363 B1 5/2002 Rajic et al.
6,387,039 B1 5/2002 Moses
6,393,130 B1 5/2002 Stonikas et al.
6,422,991 B1 7/2002 Jaeger
6,432,248 B1 8/2002 Popp et al.
6,436,028 B1 8/2002 Dormer
6,438,244 B1 8/2002 Juneau et al.
6,445,799 B1 9/2002 Taenzer et al.
6,473,512 B1 10/2002 Juneau et al.
6,475,134 B1 11/2002 Ball et al.
6,491,644 B1 12/2002 Vujanic et al.
6,493,453 B1 12/2002 Glendon
6,493,454 B1 12/2002 Loi et al.
6,498,858 B2 12/2002 Kates
6,519,376 B2 2/2003 Biagi et al.
6,536,530 B2 3/2003 Schultz et al.
6,537,200 B2 3/2003 Leysieffer et al.
6,549,633 B1 4/2003 Westermann
6,549,635 B1 4/2003 Gebert
6,554,761 B1 4/2003 Puria et al.
6,575,894 B2 6/2003 Leysieffer et al.
6,592,513 B1 7/2003 Kroll et al.
6,603,860 B1 8/2003 Taenzer et al.
6,620,110 B2 9/2003 Schmid
6,626,822 B1 9/2003 Jaeger et al.
6,629,922 B1 10/2003 Puria et al.
6,631,196 B1 10/2003 Taenzer et al.
6,663,575 B2 12/2003 Leysieffer
6,668,062 B1 12/2003 Luo et al.
6,676,592 B2 1/2004 Ball et al.
6,681,022 B1 1/2004 Puthuff et al.
6,695,943 B2 2/2004 Juneau et al.
6,697,674 B2 2/2004 Leysieffer
6,724,902 B1 * 4/2004 Shennib ..... H04R 25/456 381/322
6,726,618 B2 4/2004 Miller
6,726,718 B1 4/2004 Carlyle et al.
6,727,789 B2 4/2004 Tibbetts et al.
6,728,024 B2 4/2004 Ribak
6,735,318 B2 5/2004 Cho
6,754,358 B1 6/2004 Boesen et al.
6,754,359 B1 6/2004 Svean et al.
6,754,537 B1 6/2004 Harrison et al.
6,785,394 B1 8/2004 Olsen et al.
6,801,629 B2 10/2004 Brimhall et al.
6,829,363 B2 12/2004 Sacha
6,837,857 B2 * 1/2005 Stirnemann ..... A61B 5/121 600/559
6,842,647 B1 1/2005 Griffith et al.
6,888,949 B1 5/2005 Vanden et al.
6,900,926 B2 5/2005 Ribak
6,912,289 B2 6/2005 Vonlanthen et al.
6,920,340 B2 7/2005 Laderman
6,931,231 B1 8/2005 Griffin
6,940,988 B1 * 9/2005 Shennib ..... H04R 25/60 181/130
6,940,989 B1 * 9/2005 Shennib ..... H04R 25/606 381/326
D512,979 S 12/2005 Corcoran et al.
6,975,402 B2 12/2005 Bisson et al.
6,978,159 B2 12/2005 Feng et al.
7,043,037 B2 5/2006 Lichtblau et al.
7,050,675 B2 5/2006 Zhou et al.
7,050,876 B1 5/2006 Fu et al.
7,057,256 B2 6/2006 Mazur et al.
7,058,182 B2 6/2006 Kates
7,072,475 B1 7/2006 Denap et al.
7,076,076 B2 7/2006 Bauman
7,095,981 B1 8/2006 Voroba et al.
7,167,572 B1 1/2007 Harrison et al.
7,174,026 B2 2/2007 Niederdrank
7,203,331 B2 4/2007 Boesen
7,239,069 B2 7/2007 Cho
7,245,732 B2 7/2007 Jorgensen et al.
7,255,457 B2 8/2007 Ducharme et al.
7,266,208 B2 9/2007 Charvin et al.
7,289,639 B2 10/2007 Abel et al.
7,313,245 B1 * 12/2007 Shennib ..... A61F 11/08 128/864
7,322,930 B2 1/2008 Jaeger et al.
7,349,741 B2 3/2008 Maltan et al.
7,354,792 B2 4/2008 Mazur et al.
7,376,563 B2 5/2008 Leysieffer et al.
7,390,689 B2 6/2008 Mazur et al.
7,394,909 B1 7/2008 Widmer et al.
7,421,087 B2 9/2008 Perkins et al.
7,424,122 B2 9/2008 Ryan
7,444,877 B2 11/2008 Li et al.
7,547,275 B2 6/2009 Cho et al.
7,630,646 B2 12/2009 Anderson et al.
7,668,325 B2 2/2010 Puria et al.
7,747,295 B2 6/2010 Choi
7,826,632 B2 * 11/2010 Von Buol ..... H04R 25/405 381/313
7,853,033 B2 12/2010 Maltan et al.
7,867,160 B2 1/2011 Pluvinage et al.
7,983,435 B2 7/2011 Moses
8,090,134 B2 1/2012 Takigawa et al.
8,128,551 B2 3/2012 Jolly
8,157,730 B2 4/2012 Leboeuf et al.
8,197,461 B1 6/2012 Arenberg et al.
8,204,786 B2 6/2012 Leboeuf et al.
8,233,651 B1 7/2012 Haller
8,251,903 B2 8/2012 Leboeuf et al.
8,295,505 B2 10/2012 Weinans et al.
8,295,523 B2 10/2012 Fay et al.
8,320,601 B2 11/2012 Takigawa et al.
8,320,982 B2 11/2012 Leboeuf et al.
8,340,335 B1 * 12/2012 Shennib ..... H04R 25/60 381/315
8,391,527 B2 3/2013 Feucht et al.
8,396,239 B2 3/2013 Fay et al.
8,401,212 B2 * 3/2013 Puria ..... H04R 25/405 381/312
8,506,473 B2 8/2013 Puria
8,512,242 B2 8/2013 Leboeuf et al.

(56) References Cited

U.S. PATENT DOCUMENTS 8,526,651 B2 9/2013 Van et al.
8,545,383 B2 10/2013 Wenzel et al.
8,600,089 B2 12/2013 Wenzel et al.
8,647,270 B2 2/2014 Leboeuf et al.
8,652,040 B2 2/2014 Leboeuf et al.
8,696,054 B2 4/2014 Crum
8,696,541 B2 4/2014 Pluvinage et al.
8,700,111 B2 4/2014 Leboeuf et al.
8,702,607 B2 4/2014 Leboeuf et al.
8,715,152 B2 5/2014 Puria et al.
8,715,153 B2 5/2014 Puria et al.
8,715,154 B2 5/2014 Perkins et al.
8,761,423 B2 6/2014 Wagner et al.
8,788,002 B2 7/2014 Leboeuf et al.
8,824,715 B2 9/2014 Fay et al.
8,855,323 B2 * 10/2014 Kroman ..... H04R 25/305 381/312
8,858,419 B2 10/2014 Puria et al.
8,885,860 B2 11/2014 Djalilian et al.
8,886,269 B2 11/2014 Leboeuf et al.
8,888,701 B2 11/2014 Leboeuf et al.
8,923,941 B2 12/2014 Leboeuf et al.
8,929,965 B2 1/2015 Leboeuf et al.
8,929,966 B2 1/2015 Leboeuf et al.
8,934,952 B2 1/2015 Leboeuf et al.
8,942,776 B2 1/2015 Leboeuf et al.
8,961,415 B2 2/2015 Leboeuf et al.
8,989,830 B2 3/2015 Leboeuf et al.
9,044,180 B2 6/2015 Leboeuf et al.
9,049,528 B2 6/2015 Fay et al.
9,131,312 B2 9/2015 Leboeuf et al.
9,154,891 B2 10/2015 Puria et al.
9,211,069 B2 12/2015 Larsen et al.
9,226,083 B2 12/2015 Puria et al.
9,289,135 B2 3/2016 Leboeuf et al.
9,289,175 B2 3/2016 Leboeuf et al.
9,301,696 B2 4/2016 Leboeuf et al.
9,314,167 B2 4/2016 Leboeuf et al.
9,392,377 B2 7/2016 Olsen et al.
9,427,191 B2 8/2016 Leboeuf et al.
9,521,962 B2 12/2016 Leboeuf
9,538,921 B2 1/2017 Leboeuf et al.
9,544,700 B2 1/2017 Puria et al.
9,750,462 B2 9/2017 Leboeuf et al.
9,788,785 B2 10/2017 Leboeuf
9,788,794 B2 10/2017 Leboeuf et al.
9,794,653 B2 10/2017 Aumer et al.
9,801,552 B2 10/2017 Romesburg et al.
9,808,204 B2 11/2017 Leboeuf et al.
2001/0003788 A1 6/2001 Ball et al.
2001/0007050 A1 7/2001 Adelman
2001/0024507 A1 9/2001 Boesen
2001/0027342 A1 10/2001 Dormer
2001/0043708 A1 * 11/2001 Brimhall ..... H04R 25/456 381/328
2001/0053871 A1 12/2001 Zilberman et al.
2002/0012438 A1 1/2002 Leysieffer et al.
2002/0029070 A1 3/2002 Leysieffer et al.
2002/0030871 A1 3/2002 Anderson et al.
2002/0035309 A1 3/2002 Leysieffer
2002/0085728 A1 * 7/2002 Shennib ..... H04R 25/456 381/328
2002/0086715 A1 7/2002 Sahagen
2002/0172350 A1 11/2002 Edwards et al.
2002/0183587 A1 12/2002 Dormer
2003/0021903 A1 1/2003 Shlenker et al.
2003/0064746 A1 4/2003 Rader et al.
2003/0081803 A1 5/2003 Petilli et al.
2003/0097178 A1 5/2003 Roberson et al.
2003/0125602 A1 7/2003 Sokolich et al.
2003/0142841 A1 7/2003 Wiegand
2003/0208099 A1 11/2003 Ball
2003/0208888 A1 11/2003 Fearing et al.
2004/0019294 A1 * 1/2004 Stirnemann ..... A61B 5/121 600/559
2004/0165742 A1 * 8/2004 Shennib ..... H04R 25/456 381/326
2004/0166495 A1 * 8/2004 Greinwald, Jr. ..... C12Q 1/6883 435/6.15
2004/0167377 A1 8/2004 Schafer et al.
2004/0184732 A1 9/2004 Zhou et al.
2004/0202339 A1 10/2004 O'Brien et al.
2004/0202340 A1 10/2004 Armstrong et al.
2004/0208333 A1 10/2004 Cheung et al.
2004/0234089 A1 11/2004 Rembrand et al.
2004/0234092 A1 * 11/2004 Wada ..... H04R 25/554 381/331
2004/0236416 A1 11/2004 Falotico
2004/0240691 A1 12/2004 Grafenberg
2005/0018859 A1 1/2005 Buchholz
2005/0020873 A1 * 1/2005 Berrang ..... A61N 1/36032 600/25
2005/0036639 A1 2/2005 Bachler et al.
2005/0038498 A1 2/2005 Dubrow et al.
2005/0088435 A1 4/2005 Geng
2005/0101830 A1 5/2005 Easter et al.
2005/0163333 A1 7/2005 Abel et al.
2005/0226446 A1 10/2005 Luo et al.
2005/0271870 A1 12/2005 Jackson
2006/0015155 A1 1/2006 Charvin et al.
2006/0023908 A1 2/2006 Perkins et al.
2006/0058573 A1 3/2006 Neisz et al.
2006/0062420 A1 3/2006 Araki
2006/0074159 A1 4/2006 Lu et al.
2006/0075175 A1 4/2006 Jensen et al.
2006/0107744 A1 5/2006 Li et al.
2006/0161255 A1 7/2006 Zarowski et al.
2006/0177079 A1 8/2006 Baekgaard et al.
2006/0183965 A1 8/2006 Kasic et al.
2006/0189841 A1 8/2006 Pluvinage et al.
2006/0231914 A1 10/2006 Carey
2006/0233398 A1 10/2006 Husung
2006/0237126 A1 10/2006 Guffrey et al.
2006/0247735 A1 11/2006 Honert et al.
2006/0251278 A1 11/2006 Puria et al.
2006/0256989 A1 11/2006 Olsen et al.
2006/0278245 A1 12/2006 Gan
2007/0030990 A1 * 2/2007 Fischer ..... H04R 25/407 381/318
2007/0036377 A1 * 2/2007 Stirnemann ..... H04R 25/505 381/315
2007/0076913 A1 4/2007 Schanz
2007/0083078 A1 4/2007 Easter et al.
2007/0100197 A1 5/2007 Perkins et al.
2007/0127748 A1 6/2007 Carlile et al.
2007/0127752 A1 6/2007 Armstrong
2007/0127766 A1 6/2007 Combest
2007/0135870 A1 6/2007 Shanks et al.
2007/0161848 A1 7/2007 Dalton et al.
2007/0191673 A1 8/2007 Ball et al.
2007/0206825 A1 9/2007 Thomasson
2007/0225776 A1 9/2007 Fritsch et al.
2007/0236704 A1 10/2007 Carr et al.
2007/0250119 A1 10/2007 Tyler et al.
2007/0251082 A1 11/2007 Milojevic et al.
2007/0286429 A1 12/2007 Grafenberg et al.
2008/0021518 A1 1/2008 Hochmair et al.
2008/0051623 A1 2/2008 Schneider et al.
2008/0054509 A1 3/2008 Berman et al.
2008/0063228 A1 3/2008 Mejia et al.
2008/0063231 A1 * 3/2008 Juneau ..... H04R 25/456 381/328
2008/0064918 A1 3/2008 Jolly
2008/0089292 A1 4/2008 Kitazoe et al.
2008/0107292 A1 5/2008 Kornagel
2008/0123866 A1 5/2008 Rule et al.
2008/0188707 A1 8/2008 Bernard et al.
2008/0298600 A1 12/2008 Poe et al.
2008/0300703 A1 * 12/2008 Widmer ..... H04R 25/652 700/97
2009/0023976 A1 1/2009 Cho et al.
2009/0043149 A1 2/2009 Abel et al.
2009/0076581 A1 3/2009 Gibson

(56) References Cited

U.S. PATENT DOCUMENTS

2009/0092271 A1 4/2009 Fay et al.
2009/0097681 A1* 4/2009 Puria ..... H04R 25/405 381/318
2009/0141919 A1 6/2009 Spitaels et al.
2009/0149697 A1 6/2009 Steinhardt et al.
2009/0253951 A1 10/2009 Ball et al.
2009/0262966 A1 10/2009 Vestergaard et al.
2009/0281367 A1 11/2009 Cho et al.
2009/0310805 A1 12/2009 Petroff
2010/0034409 A1 2/2010 Fay et al.
2010/0036488 A1 2/2010 De Juan, Jr. et al.
2010/0048982 A1 2/2010 Puria et al.
2010/0085176 A1 4/2010 Flick
2010/0111315 A1* 5/2010 Kroman ..... H04R 25/305 381/60
2010/0152527 A1 6/2010 Puria
2010/0177918 A1* 7/2010 Keady ..... H04R 25/654 381/318
2010/0202645 A1 8/2010 Puria et al.
2010/0222639 A1 9/2010 Purcell et al.
2010/0272299 A1* 10/2010 Van Schuylenbergh .... H04R 25/554 381/315
2010/0290653 A1 11/2010 Wiggins et al.
2010/0312040 A1 12/2010 Puria et al.
2011/0069852 A1* 3/2011 Arndt ..... H04R 25/48 381/317
2011/0077453 A1 3/2011 Pluvinage et al.
2011/0112462 A1 5/2011 Parker et al.
2011/0116666 A1 5/2011 Dittberner et al.
2011/0152602 A1 6/2011 Perkins et al.
2011/0182453 A1* 7/2011 Van Hal ..... H04R 25/60 381/328
2011/0221391 A1 9/2011 Won et al.
2011/0258839 A1* 10/2011 Probst ..... H04R 25/652 29/594
2012/0008807 A1 1/2012 Gran
2012/0014546 A1 1/2012 Puria et al.
2012/0039493 A1 2/2012 Rucker et al.
2012/0140967 A1 6/2012 Aubert et al.
2012/0236524 A1 9/2012 Pugh et al.
2013/0034258 A1 2/2013 Lin
2013/0083938 A1* 4/2013 Bakalos ..... G10K 11/1788 381/71.8
2013/0287239 A1 10/2013 Fay et al.
2013/0308782 A1 11/2013 Dittberner et al.
2013/0343584 A1 12/2013 Bennett et al.
2013/0343585 A1 12/2013 Bennett et al.
2014/0003640 A1 1/2014 Puria et al.
2014/0056453 A1* 2/2014 Olsen ..... H04R 25/02 381/328
2014/0153761 A1* 6/2014 Shennib ..... H04R 25/652 381/328
2014/0169603 A1 6/2014 Sacha et al.
2014/0254856 A1 9/2014 Blick et al.
2014/0286514 A1 9/2014 Pluvinage et al.
2014/0288356 A1 9/2014 Van Vlem
2014/0296620 A1* 10/2014 Puria ..... H04R 23/008 600/25
2014/0321657 A1* 10/2014 Stirnemann ..... H04R 25/70 381/60
2014/0379874 A1 12/2014 Starr et al.
2015/0010185 A1 1/2015 Puria et al.
2015/0023540 A1 1/2015 Fay et al.
2015/0031941 A1 1/2015 Perkins et al.
2015/0201269 A1 7/2015 Dahl et al.
2015/0222978 A1 8/2015 Murozaki et al.
2015/0271609 A1* 9/2015 Puria ..... H04R 25/456 381/328
2016/0029132 A1 1/2016 Freed et al.
2016/0064814 A1 3/2016 Jang et al.
2016/0066101 A1 3/2016 Puria et al.
2016/0302011 A1 10/2016 Olsen et al.
2016/0309265 A1 10/2016 Pluvinage et al.
2016/0309266 A1* 10/2016 Olsen ..... G01S 15/88
2017/0095202 A1 4/2017 Facteau et al.
2017/0134866 A1 5/2017 Puria et al.
2017/0150275 A1 5/2017 Puria et al.
2017/0195801 A1 7/2017 Rucker et al.
2017/0195804 A1 7/2017 Sandhu et al.
2017/0195806 A1 7/2017 Atamaniuk et al.
2017/0195809 A1 7/2017 Teran et al.
2018/0007472 A1 1/2018 Puria et al.
2018/0014128 A1 1/2018 Puria et al.
2018/0020291 A1 1/2018 Puria et al.
2018/0020296 A1 1/2018 Wenzel
2018/0063652 A1 3/2018 Perkins et al.

FOREIGN PATENT DOCUMENTS

DE 3243850 A1 5/1984
DE 3508830 A1 9/1986
EP 0092822 A2 11/1983
EP 0242038 A2 10/1987
EP 0291325 A2 11/1988
EP 0296092 A2 12/1988
EP 0242038 A3 5/1989
EP 0296092 A3 8/1989
EP 0352954 A2 1/1990
EP 0291325 A3 6/1990
EP 0352954 A3 8/1991
EP 1845919 A1 10/2007
EP 1845919 B1 9/2010
FR 2455820 A1 11/1980
JP S60154800 A 8/1985
JP H09327098 A 12/1997
JP 2000504913 A 4/2000
JP 2004187953 A 7/2004
KR 100624445 B1 9/2006
WO WO-9209181 A1 5/1992
WO WO-9621334 A1 7/1996
WO WO-9736457 A1 10/1997
WO WO-9745074 A1 12/1997
WO WO-9806236 A1 2/1998
WO WO-9903146 A1 1/1999
WO WO-9915111 A1 4/1999
WO WO-0022875 A2 4/2000
WO WO-0022875 A3 7/2000
WO WO-0150815 A1 7/2001
WO WO-0158206 A2 8/2001
WO WO-0176059 A2 10/2001
WO WO-0158206 A3 2/2002
WO WO-0239874 A2 5/2002
WO WO-0239874 A3 2/2003
WO WO-03063542 A2 7/2003
WO WO-03063542 A3 1/2004
WO WO-2004010733 A1 1/2004
WO WO-2005015952 A1 2/2005
WO WO-2005107320 A1 11/2005
WO WO-2006014915 A2 2/2006
WO WO-2006037156 A1 4/2006
WO WO-2006042298 A2 4/2006
WO WO-2006075169 A1 7/2006
WO WO-2006075175 A1 7/2006
WO WO-2006118819 A2 11/2006
WO WO-2006042298 A3 12/2006
WO WO-2009046329 A1 4/2009
WO WO-2009047370 A2 4/2009
WO WO-2009049320 A1 4/2009
WO WO-2009056167 A1 5/2009
WO WO-2009047370 A3 7/2009
WO WO-2009145842 A2 12/2009
WO WO-2009146151 A2 12/2009
WO WO-2009155358 A1 12/2009
WO WO-2009155361 A1 12/2009
WO WO-2010033932 A1 3/2010
WO WO-2010033933 A1 3/2010
WO WO-2010077781 A2 7/2010
WO WO-2012088187 A2 6/2012
WO WO-2012149970 A1 11/2012
WO WO-2016011044 A1 1/2016

(56) References Cited

FOREIGN PATENT DOCUMENTS

WO WO-2017116791 A1 7/2017
WO WO-2017116865 A1 7/2017

OTHER PUBLICATIONS

Co-pending U.S. Appl. No. 14/813,301, filed Jul. 30, 2015.
Co-pending U.S. Appl. No. 14/843,030, filed Sep. 2, 2015.
Co-pending U.S. Appl. No. 14/949,495, filed Nov. 23, 2015.
Killion, et al. The case of the missing dots: AI and SNR loss. The Hearing Journal, 1998. 51(5), 32-47.
Moore, et al. Perceived naturalness of spectrally distorted speech and music. J Acoust Soc Am. Jul. 2003;114(1):408-19.
O'Connor, et al. Middle ear Cavity and Ear Canal Pressure-Driven Stapes Velocity Responses in Human Cadaveric Temporal Bones. J Acoust Soc Am. Sep. 2006;120(3):1517-28.
Puria, et al. Tympanic-membrane and malleus-incus-complex co-adaptations for high-frequency hearing in mammals. Hear Res. May 2010;263(1-2):183-90. doi: 10.1016/j.heares.2009.10.013. Epub Oct. 28, 2009.
Puria. Measurements of human middle ear forward and reverse acoustics: implications for otoacoustic emissions. J Acoust Soc Am. May 2003;113(5):2773-89.
Co-pending U.S. Appl. No. 14/988,304, filed Jan. 5, 2016.
Notice of allowance dated Mar. 16, 2016 for U.S. Appl. No. 13/919,079.
Jian, et al. A 0.6 V, 1.66 mW energy harvester and audio driver for tympanic membrane transducer with wirelessly optical signal and power transfer. InCircuits and Systems (ISCAS), 2014 IEEE International Symposium on Jun. 1, 2014. 874-7. IEEE.
Song, et al. The development of a non-surgical direct drive hearing device with a wireless actuator coupled to the tympanic membrane. Applied Acoustics. Dec. 31, 2013;74(12):1511-8.
Atasoy [Paper] Opto-acoustic Imaging. for BYM504E Biomedical Imaging Systems class at ITU, downloaded from the Internet www2.itu.edu.td-cilesiz/courses/BYM504- 2005-OA 504041413. pdf, 14 pages.
Athanassiou, et al. Laser controlled photomechanical actuation of photochromic polymers Microsystems. Rev. Adv. Mater. Sci. 2003; 5:245-251.
Ayatollahi, et al. Design and Modeling of Micromachined Condenser MEMS Loudspeaker using Permanent Magnet Neodymium-Iron-Boron (Nd—Fe—B). IEEE International Conference on Semiconductor Electronics, 2006. ICSE '06, Oct. 29, 2006-Dec. 1, 2006; 160-166.
Baer, et al. Effects of Low Pass Filtering on the Intelligibility of Speech in Noise for People With and Without Dead Regions at High Frequencies. J. Acost. Soc. Am 112(3), pt. 1, (Sep. 2002), pp. 1133-1144.
Best, et al. The influence of high frequencies on speech localization. Abstract 981 (Feb. 24, 2003) from www.aro.org/abstracts/abstracts.html.
Birch, et al. Microengineered systems for the hearing impaired. IEE Colloquium on Medical Applications of Microengineering, Jan. 31, 1996; pp. 2/1-2/5.
Burkhard, et al. Anthropometric Manikin for Acoustic Research. J. Acoust. Soc. Am., vol. 58, No. 1, (Jul. 1975), pp. 214-222.
Camacho-Lopez, et al. Fast Liquid Crystal Elastomer Swims Into the Dark, Electronic Liquid Crystal Communications. Nov. 26, 2003; 9 pages total.
Carlile, et al. Spatialisation of talkers and the segregation of concurrent speech. Abstract 1264 (Feb. 24, 2004) from www.aro.org/abstracts/abstracts.html.
Cheng, et al. A Silicon Microspeaker for Hearing Instruments. Journal of Micromechanics and Microengineering 2004; 14(7):859-866.
Co-pending U.S. Appl. No. 14/554,606, filed Nov. 26, 2014.
Datskos, et al. Photoinduced and thermal stress in silicon microcantilevers. Applied Physics Letters. Oct. 19, 1998; 73(16):2319-2321.
Decraemer, et al. A method for determining three-dimensional vibration in the ear. Hearing Res., 77:19-37 (1994).
Ear. Retrieved from the Internet: http://wwwmgs.bionet.nsc.ru/mgs/gnw/trrd/thesaurus/Se/ear.html. Accessed Jun. 17, 2008.
European search report and opinion dated Jun. 12, 2009 for EP 06758467.2.
Fay, et al. Cat eardrum response mechanics. Mechanics and Computation Division. Department of Mechanical Engineering. Standford University. 2002; 10 pages total.
Fletcher. Effects of Distortion on the Individual Speech Sounds. Chapter 18, ASA Edition of Speech and Hearing in Communication, Acoust Soc.of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.
Gobin, et al. Comments on the physical basis of the active materials concept. Proc. SPIE 2003; 4512:84-92.
Hato, et al. Three-dimensional stapes footplate motion in human temporal bones. Audiol. Neurootol., 8:140-152 (Jan. 30, 2003).
Headphones. Wikipedia Entry, downloaded from the Internet : en.wikipedia.org/wiki/Headphones. 9 pages total.
Hofman, et al. Relearning Sound Localization With New Ears. Nature Neuroscience, vol. 1, No. 5, (Sep. 1998); 417-421.
International search report and written opinion dated Aug. 7, 2009 for PCT/US2009/047682.
International search report and written opinion dated Sep. 20, 2006 for PCT/US2005/036756.
International search report and written opinion dated Oct. 17, 2007 for PCT/US2006/015087.
International search report and written opinion dated Nov. 23, 2009 for PCT/US2009/047685.
International search report and written opinion dated Dec. 8, 2008 for PCT/US2008/078793.
International search report and written opinion dated Dec. 24, 2008 for PCT/US2008/079868.
Jin, et al. Speech Localization. J. Audio Eng. Soc. convention paper, presented at the AES 112th Convention, Munich, Germany, May 10-13, 2002, 13 pages total.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lee, et al. A Novel Opto-Electromagnetic Actuator Coupled to the tympanic Membrane. J Biomech. Dec. 5, 2008;41(16):3515-8. Epub Nov. 7, 2008.
Lee, et al. The optimal magnetic force for a novel actuator coupled to the tympanic membrane: a finite element analysis. Biomedical engineering: applications, basis and communications. 2007; 19(3):171-177.
Lezal. Chalcogenide glasses—survey and progress. Journal of Optoelectronics and Advanced Materials. Mar. 2003; 5(1):23-34.
Martin, et al. Utility of Monaural Spectral Cues is Enhanced in the Presence of Cues to Sound-Source Lateral Angle. JARO. 2004; 5:80-89.
Moore. Loudness perception and intensity resolution. Cochlear Hearing Loss, Chapter 4, pp. 90-115, Whurr Publishers Ltd., London (1998).
Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.

(56) References Cited

OTHER PUBLICATIONS

Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Malleus-to-footplate ossicular reconstruction prosthesis positioning: cochleovestibular pressure optimization. Otol Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements in the Cochlear Vestibule of Human-Cadaver Ears. Journal of the Acoustical Society of America. 1997; 101 (5-1): 2754-2770.
Sekaric, et al. Nanomechanical resonant structures as tunable passive modulators. App. Phys. Lett. Nov. 2003; 80(19):3617-3619.
Shaw. Transformation of Sound Pressure Level From the Free Field to the Eardrum in the Horizontal Plane. J. Acoust. Soc. Am., vol. 56, No. 6, (Dec. 1974), 1848-1861.
Shih. Shape and displacement control of beams with various boundary conditions via photostrictive optical actuators. Proc. IMECE. Nov. 2003; 1-10.
Sound Design Technologies,—Voyager TDTM Open Platform DSP System for Ultra Low Power Audio Processing—GA3280 Data Sheet. Oct. 2007; retrieved from the Internet: <<http://www.sounddes.com/pdf/37601DOC.pdf>>, 15 page total.
Stuchlik, et al. Micro-Nano Actuators Driven by Polarized Light. IEEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
Thompson. Tutorial on microphone technologies for directional hearing aids. Hearing Journal. Nov. 2003; 56(11):14-16,18, 20-21.
Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
U.S. Appl. No. 61/073,271, filed Jun. 17, 2008.
U.S. Appl. No. 61/073,281, filed Jun. 17, 2008.
Vickers, et al. Effects of Low-Pass Filtering on the Intelligibility of Speech in Quiet for People With and Without Dead Regions at High Frequencies. J. Acoust. Soc. Am. Aug. 2001; 110(2):1164-1175.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Wiener, et al. On the Sound Pressure Transformation by the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.
Fay, et al. Preliminary evaluation of a light-based contact hearing device for the hearing impaired. Otol Neurotol. Jul. 2013;34(5):912-21. doi: 10.1097/MAO.0b013e31827de4b1.
Asbeck, et al. Scaling Hard Vertical Surfaces with Compliant Microspine Arrays, The International Journal of Robotics Research 2006; 25; 1165-79.
Autumn, et al. Dynamics of geckos running vertically, The Journal of Experimental Biology 209, 260-272, (2006).
Autumn, et al., Evidence for van der Waals adhesion in gecko setae, www.pnas.orgycgiydoiy10.1073ypnas.192252799 (2002).
Boedts. Tympanic epithelial migration, Clinical Otolaryngology 1978, 3, 249-253.
Cheng; et al. A silicon microspeaker for hearing instruments. Journal of Micromechanics and Microengineering 14, No. 7 (2004): 859-866.
Co-pending U.S. Appl. No. 15/042,595, filed Feb. 12, 2016.
Fay. Cat eardrum mechanics. Ph.D. thesis. Disseration submitted to Department of Aeronautics and Astronautics. Standford University. May 2001; 210 pages total.
Fay, et al. The discordant eardrum, PNAS, Dec. 26, 2006, vol. 103, No. 52, p. 19743-19748.
Gantz, et al. Light-Driven Contact Hearing Aid for Broad-Spectrum Amplification: Safety and Effectiveness Pivotal Study. Otology & Neurotology. Copyright 2016. 7 pages.
Ge, et al., Carbon nanotube-based synthetic gecko tapes, p. 10792-10795, PNAS, Jun. 26, 2007, vol. 104, No. 26.
Gorb, et al. Structural Design and Biomechanics of Friction-Based Releasable Attachment Devices in Insects, Integr. Comp_Biol., 42:1127-1139 (2002).
Izzo, et al. Laser Stimulation of Auditory Neurons: Effect of Shorter Pulse Duration and Penetration Depth. Biophys J. Apr. 15, 2008;94(8):3159-3166.
Izzo, et al. Laser Stimulation of the Auditory Nerve. Lasers Surg Med. Sep. 2006;38(8):745-753.
Izzo, et al. Selectivity of Neural Stimulation in the Auditory System: A Comparison of Optic and Electric Stimuli. J Biomed Opt. Mar.-Apr. 2007;12(2):021008.
Makino, et al. Epithelial migration in the healing process of tympanic membrane perforations. Eur Arch Otorhinolaryngol. 1990; 247: 352-355.
Makino, et al., Epithelial migration on the tympanic membrane and external canal, Arch Otorhinolaryngol (1986) 243:39-42.
Markoff. Intuition + Money: An Aha Moment. New York Times Oct. 11, 2008, p. BU4, 3 pages total.
Michaels, et al., Auditory Epithelial Migration on the Human Tympanic Membrane: II. The Existence of Two Discrete Migratory Pathways and Their Embryologic Correlates, The American Journal of Anatomy 189:189-200 (1990).
Murphy M, Aksak B, Sitti M. Adhesion and anisotropic friction enhancements of angled heterogeneous micro-fiber arrays with spherical and spatula tips. J Adhesion Sci Technol, vol. 21, No. 12-13, p. 1281-1296, 2007.
Nishihara, et al. Effect of changes in mass on middle ear function. Otolaryngol Head Neck Surg. Nov. 1993;109(5):889-910.
Puria, et al., Mechano-Acoustical Transformations in A. Basbaum et al., eds., The Senses: A Comprehensive Reference, v3, p. 165-202, Academic Press (2008).
Qu, et al. Carbon Nanotube Arrays with Strong Shear Binding-On and Easy Normal Lifting-Off, Oct. 10, 2008 vol. 322 Science. 238-242.
Roush. SiOnyx Brings "Black Silicon" into the Light; Material Could Upend Solar, Imaging Industries. Xconomy, Oct. 12, 2008, retrieved from the Internet: www.xconomy.com/boston/2008/10/12/sionyx-brings-black-silicon-into-the-light¬material-could-upend-solar-imaging-industries> 4 pages total.
R.P. Jackson, C. Chlebicki, T.B. Krasieva, R. Zalpuri, W.J. Triffo, S. Puria, "Multiphoton and Transmission Electron Microscopy of Collagen in Ex Vivo Tympanic Membranes," Biomedcal Computation at STandford, Oct. 2008.

(56) References Cited

OTHER PUBLICATIONS

Rubinstein. How Cochlear Implants Encode Speech, Curr Opin Otolaryngol Head Neck Surg. Oct. 2004;12(5):444-8; retrieved from the Internet: www.ohsu.edu/nod/documents/week3/Rubenstein.pdf.
Spolenak, et al. Effects of contact shape on the scaling of biological attachments. Proc. R. Soc. A. 2005; 461:305-319.
Stenfelt, et al. Bone-Conducted Sound: Physiological and Clinical Aspects. Otology & Neurotology, Nov. 2005; 26 (6):1245-1261.
The Scientist and Engineers Guide to Digital Signal Processing, copyright 01997-1998 by Steven W. Smith, available online at www.DSPguide.com.
Vinikman-Pinhasi, et al. Piezoelectric and Piezooptic Effects in Porous Silicon. Applied Physics Letters, Mar. 2006; 88(11): 11905-111906.
Yao, et al. Adhesion and sliding response of a biologically inspired fibrillar surface: experimental observations, J. R. Soc. Interface (2008) 5, 723-733 doi:10.1098/rsif.2007.1225 Published online Oct. 30, 2007.
Yao, et al. Maximum strength for intermolecular adhesion of nanospheres at an optimal size. J. R. Soc. Interface doi:10.10981rsif.2008.0066 Published online 2008.
Co-pending U.S. Appl. No. 15/282,570, filed Sep. 30, 2016.
Fritsch, et al. EarLens transducer behavior in high-field strength MRI scanners. Otolaryngol Head Neck Surg. Mar. 2009;140(3):426-8. doi: 10.1016/j.otohns.2008.10.016.
Gantz, et al. Broad Spectrum Amplification with a Light Driven Hearing System. Combined Otolaryngology Spring Meetings, 2016 (Chicago).
Gantz, et al. Light Driven Hearing Aid: A Multi-Center Clinical Study. Association for Research in Otolaryngology Annual Meeting, 2016 (San Diego).
Gantz, et al. Light-Driven Contact Hearing Aid for Broad Spectrum Amplification: Safety and Effectiveness Pivotal Study. Otology & Neurotology Journal, 2016 (in review).
Khaleghi, et al. Characterization of Ear-Canal Feedback Pressure due to Umbo-Drive Forces: Finite-Element vs. Circuit Models. ARO Midwinter Meeting 2016, (San Diego).
Levy, et al. Characterization of the available feedback gain margin at two device microphone locations, in the fossa triangularis and Behind the Ear, for the light-based contact hearing device. Acoustical Society of America (ASA) meeting, 2013 (San Francisco).
Levy, et al. Extended High-Frequency Bandwidth Improves Speech Reception in the Presence of Spatially Separated Masking Speech. Ear Hear. Sep.-Oct. 2015;36(5):e214-24. doi: 10.1097/Aud.0000000000000161.
Moore, et al. Spectro-temporal characteristics of speech at high frequencies, and the potential for restoration of audibility to people with mild-to-moderate hearing loss. Ear Hear. Dec. 2008;29(6):907-22. doi: 10.1097/AUD.0b013e31818246f6.
Perkins, et al. Light-based Contact Hearing Device: Characterization of available Feedback Gain Margin at two device microphone locations. Presented at AAO-HNSF Annual Meeting, 2013 (Vancouver).
Perkins, et al. The EarLens Photonic Transducer: Extended bandwidth. Presented at AAO-HNSF Annual Meeting, 2011 (San Francisco).
Perkins, et al. The EarLens System: New sound transduction methods. Hear Res. Feb. 2, 2010; 10 pages total.
Perkins, R. Earlens tympanic contact transducer: a new method of sound transduction to the human ear. Otolaryngol Head Neck Surg. Jun. 1996;114(6):720-8.
Puria, et al. Cues above 4 kilohertz can improve spatially separated speech recognition. The Journal of the Acoustical Society of America, 2011, 129, 2384.
Puria, et al. Extending bandwidth above 4 kHz improves speech understanding in the presence of masking speech. Association for Research in Otolaryngology Annual Meeting, 2012 (San Diego).
Puria, et al. Extending bandwidth provides the brain what it needs to improve hearing in noise. First international conference on cognitive hearing science for communication, 2011 (Linkoping, Sweden).
Puria, et al. Hearing Restoration: Improved Multi-talker Speech Understanding. 5th International Symposium on Middle Ear Mechanics in Research and Otology (MEMRO), Jun. 2009 (Stanford University).
Puria, et al. Imaging, Physiology and Biomechanics of the middle ear: Towards understating the functional consequences of anatomy. Stanford Mechanics and Computation Symposium, 2005, ed Fong J.
Puria, et al. Temporal-Bone Measurements of the Maximum Equivalent Pressure Output and Maximum Stable Gain of a Light-Driven Hearing System That Mechanically Stimulates the Umbo. Otol Neurotol. Feb. 2016;37(2):160-6. doi: 10.1097/MAO.0000000000000941.
Puria, et al. The EarLens Photonic Hearing Aid. Association for Research in Otolaryngology Annual Meeting, 2012 (San Diego).
Puria, et al. The Effects of bandwidth and microphone location on understanding of masked speech by normal-hearing and hearing-impaired listeners. International Conference for Hearing Aid Research (IHCON) meeting, 2012 (Tahoe City).
Puria, S. Middle Ear Hearing Devices. Chapter 10. Part of the series Springer Handbook of Auditory Research pp. 273-308. Date: Feb. 9, 2013.
Khaleghi, et al. Attenuating the ear canal feedback pressure of a laser-driven hearing aid. J Acoust Soc Am. Mar. 2017;141(3):1683.
Struck, et al. Comparison of Real-world Bandwidth in Hearing Aids vs Earlens Light-driven Hearing Aid System. The Hearing Review. TechTopic: EarLens. Hearingreview.com. Mar. 14, 2017. pp. 24-28.
Dundas et al. The Earlens Light-Driven Hearing Aid: Top 10 questions and answers. Hearing Review. 2018;25(2):36-39.
Khaleghi et al. Attenuating the ear canal feedback pressure of a laser-driven hearing aid. J Acoust Soc Am. Mar. 2017;141(3):1683.
Khaleghi et al. Attenuating the feedback pressure of a light-activated hearing device to allows microphone placement at the ear canal entrance. IHCON 2016, International Hearing Aid Research Conference, Tahoe City, CA, Aug. 2016.
Khaleghi et al. Mechano-Electro-Magnetic Finite Element Model of a Balanced Armature Transducer for a Contact Hearing Aid. Proc. MoH 2017, Mechanics of Hearing workshop, Brock University, Jun. 2017.
Khaleghi et al. Multiphysics Finite Element Model of a Balanced Armature Transducer used in a Contact Hearing Device. ARO 2017, 40th ARO MidWinter Meeting, Baltimore, MD, Feb. 2017.
Levy et al. Light-driven contact hearing aid: a removable direct-drive hearing device option for mild to severe sensorineural hearing impairment. Conference on Implantable Auditory Prostheses, Tahoe City, CA, Jul. 2017. 1 page.
McElveen et al. Overcoming High-Frequency Limitations of Air Conduction Hearing Devices Using a Light-Driven Contact Hearing Aid. Poster presentation at the Triological Society, 120th Annual Meeting at COSM, Apr. 28, 2017; San Diego, CA.
Park, et al. Design and analysis of a microelectromagnetic vibration transducer used as an implantable middle ear hearing aid. J. Micromech. Microeng. vol. 12 (2002), pp. 505-511.

* cited by examiner

HIGH FIDELITY AND REDUCED FEEDBACK CONTACT HEARING APPARATUS AND METHODS

CROSS-REFERENCE TO RELATED APPLICATIONS

This application claims the benefit under 35 U.S.C. § 119(e) of U.S. Provisional Application No. 61/955,016, filed Mar. 18, 2014, which application is incorporated herein by reference.

BACKGROUND

Field of the Invention

The present invention is related to systems, devices and methods that couple to tissue such as hearing systems. Although specific reference is made to hearing aid systems, embodiments of the present invention can be used in many applications in which a signal is used to stimulate the ear.

People like being able to hear. Hearing allows people to listen to and understand others. Natural hearing can include high frequency localization cues that allow a user to hear a speaker, even when background noise is present. People also like to communicate with those who are far away, such as with cellular phones, radios and other wireless and wired devices.

Hearing impaired subjects may need hearing aids to verbally communicate with those around them. Unfortunately, the prior hearing devices can provide less than ideal performance in at least some respects, such that users of prior hearing devices remain less than completely satisfied in at least some instances. Examples of deficiencies of prior hearing devices include feedback, distorted sound quality, less than desirable sound localization, discomfort and autophony. Feedback can occur when a microphone picks up amplified sound and generates a whistling sound. Autophony includes the unusually loud hearing of a person's own self-generated sounds such as voice, breathing or other internally generated sound. Possible causes of autophony include occlusion of the ear canal, which may be caused by an object blocking the ear canal and reflecting sound vibration back toward the eardrum, such as an unvented hearing aid or a plug of earwax reflecting sound back toward the eardrum.

Acoustic hearing aids can rely on sound pressure to transmit sound from a speaker within the hearing aid to the eardrum of the user. However, the sound quality can be less than ideal and the sound pressure can cause feedback to a microphone placed near the ear canal opening.

Although it has been proposed to couple a transducer to a vibratory structure of the ear to stimulate the ear with direct mechanical coupling, the clinical implementation of the prior direct mechanical coupling devices can be less than ideal in at least some instances. Coupling the transducer to the vibratory structure of the ear can provide amplified sound with decreased feedback. However, in at least some instances direct mechanical coupling of the hearing device to the vibratory structure of the ear can result in transmission of amplified sound from the eardrum to a microphone positioned near the ear canal opening that may result in feedback.

The prior methods and apparatus to decrease feedback can result in less than ideal results in at least some instances. For example, sealing the ear canal to inhibit sound leakage can result in autophony. Although, placement of the input microphone away from the ear canal opening can result in decreased feedback, microphone placement far enough from the ear canal opening to decrease feedback may also result in decreased detection of spatial localization cues.

For the above reasons, it would be desirable to provide hearing systems which at least decrease, or even avoid, at least some of the above mentioned limitations of the prior hearing devices. For example, there is a need to provide reliable, comfortable hearing devices which provide hearing with natural sound qualities, for example with spatial information cues, and which decrease autophony, distortion and feedback.

SUMMARY

The present disclosure provides improved methods and apparatus for hearing and listening, such as hearing instruments or hearing devices (including hearing aids devices, communication devices, other hearing instruments, wireless receivers and headsets), which overcome at least some of the aforementioned deficiencies of the prior devices.

In many embodiments, an output transducer may be coupled to a support structure, and the support structure configured to contact one or more of the tympanic membrane, an ossicle, the oval window or the round window. An input transducer is configured for placement near an ear canal opening to receive high frequency localization cues. A sound inhibiting structure, such as an acoustic resistor, acoustic damper, or a screen, may be positioned at a location along the ear canal between the tympanic membrane and the input transducer to inhibit feedback. A channel can be coupled to the sound inhibiting structure to provide a desired frequency response profile of the sound inhibiting structure. The channel may comprise a channel of a shell or housing placed in the ear canal, or a channel defined with components of the hearing apparatus placed in the ear canal, and combinations thereof. The channel may comprise a secondary channel extending away from an axis of the ear canal. The sound inhibiting structure (or feedback inhibiting structure) coupled to the channel can allow sound to pass through the ear canal to the tympanic membrane while providing enough attenuation to inhibit feedback. The feedback inhibiting structure can allow inhibition of resonance frequencies and frequencies near resonance frequencies such that feedback can be substantially reduced when the user hears high frequency sound localization cues with an input transducer positioned near the ear canal openings. The feedback inhibiting structure and channel can be configured to transmit high frequency localization cues and inhibit resonant frequencies. The feedback inhibiting structure can allow high frequency localization cues to be transmitted along the ear canal from the ear canal opening to the eardrum of the user.

The sound or feedback inhibiting structure can be configured in many ways, and may comprise one or more sound inhibiting structure configured for placement at one or more desired locations along the ear canal, which may comprise one or more predetermined locations along the ear canal to inhibit feedback at specific frequencies. The sound inhibiting structure may be configured to provide a predetermined amount of sound attenuation, for example, as described in the present disclosure. In many embodiments, a plurality of sound inhibiting structures can be placed at a plurality of locations along the ear canal to decrease secondary resonance peaks. Alternatively, or in combination, a channel can be provided with an opening near the one or more sound inhibiting structures to decrease resonance peaks and provide a more even distribution of frequencies transmitted through the ear canal. The channel may comprise a secondary channel having an opening located near one or more of the sound inhibiting structures and the channel may comprise a central axis extending away from an axis of the ear canal. The sound inhibiting structure can be configured so as to provide a first frequency response profile of the sound transmitted along the ear canal from the ear canal opening to the eardrum, and so as to provide a provide a second frequency response profile of the sound transmitted along the ear canal from the eardrum to the ear canal opening.

In many embodiments, the feedback inhibiting structure can be removed from the ear canal when the output transducer contacting the vibratory structure of the ear canal remains in contact with the vibratory structure of the ear. Removal of the feedback inhibiting structure can allow for increased user comfort and may allow the feedback inhibiting structure to be removed. The removable component may comprises the input transducer, such as a microphone and a support component to support the microphone near the ear canal opening and to support the one or more sound inhibiting structures.

The present disclosure also provides the methods for determining configuration and positioning of the sound inhibiting structure to achieve a desired amount of attenuation. A characteristic impedance of the hearing apparatus may be determined based on a position of the hearing apparatus when placed in the ear canal. A damper value may be determined based on the characteristic impedance. In some embodiments, a determination is made of a position of a sound inhibiting structure with the determined damper value relative to the one or more channels of the hearing apparatus to provide a predetermined amount of sound attenuation along the ear canal sufficient to inhibit feedback while allowing user audible high frequency localization cues to be transmitted toward the tympanic membrane. In some embodiments, a sound inhibiting structure with the determined damper value is coupled to the one or more channels of the hearing apparatus to provide a predetermined amount of sound attenuation along the ear canal sufficient to inhibit feedback while allowing user audible high frequency localization cues to be transmitted toward the tympanic membrane. In some embodiments, a sound inhibiting structure with the determined damper value is provided for placement relative to the one or more channels of the hearing apparatus to provide a predetermined amount of sound attenuation along the ear canal sufficient to inhibit feedback while allowing user audible high frequency localization cues to be transmitted toward the tympanic membrane.

Additional aspects of the present disclosure are recited in the claims below, and can provide additional summary in accordance with embodiments. It is contemplated that the embodiments as described herein and recited in the claims may be combined in many ways, and any one or more of the elements recited in the claims can be combined with any one or more additional or alternative elements as recited in the claims, in accordance with embodiments of the present disclosure and teachings as described herein.

Other features and advantages of the devices and methodology of the present disclosure will become apparent from the following detailed description of one or more implementations when read in view of the accompanying figures. Neither this summary nor the following detailed description purports to define the invention. The invention is defined by the claims.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

It should be noted that the drawings are not to scale and are intended only as an aid in conjunction with the explanations in the following detailed description. In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings. A better understanding of the features and advantages of the present disclosure will be obtained by reference to the following detailed description that sets forth illustrative embodiments, in which the principles of the disclosure are utilized, and the accompanying drawings of which.

DETAILED DESCRIPTION

In the following detailed description, reference is made to the accompanying drawings that show, by way of illustration, some examples of embodiments in which the disclosure may be practiced. In this regard, directional terminology, such as "medial" and "lateral," may be used with reference to the orientation of the figure(s) being described. Because components or embodiments of the present disclosure can be positioned or operated in a number of different orientations, the directional terminology is used for purposes of illustration and is in no way limiting. It is to be understood that other embodiments may be utilized and structural or logical changes may be made without departing from the scope of the present disclosure.

As used herein, light encompasses electromagnetic radiation having wavelengths within the visible, infrared and ultraviolet regions of the electromagnetic spectrum.

In many embodiments, the hearing device comprises a photonic hearing device, in which sound is transmitted with photons having energy, such that the signal transmitted to the ear can be encoded with transmitted light.

As used herein, an emitter encompasses a source that radiates electromagnetic radiation and a light emitter encompasses a light source that emits light.

As used herein like references numerals and letters indicate similar elements having similar structure, function and methods of use.

Figure 1A:
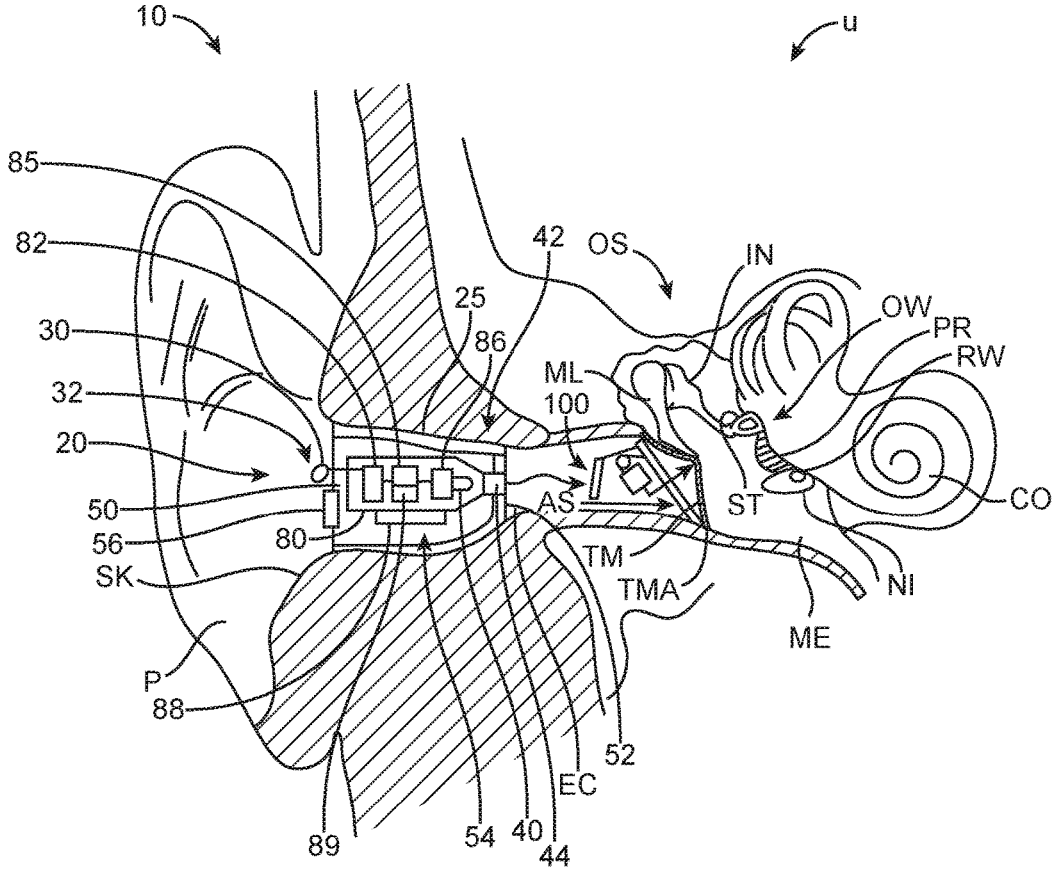
FIG. 1A shows an example of a hearing system comprising a user removable input transducer assembly configured to transmit electromagnetic energy to an output transducer assembly, in accordance with various embodiments.

FIG. 1A shows a hearing system 10 comprising a user removable input transducer assembly 20 configured to transmit electromagnetic energy EM to an output transducer assembly 100 positioned in the ear canal EC of the user. The hearing system 10 may serve as a hearing aid to a hearing-impaired subject or patient. Alternatively or in combination, the hearing system 10 may be used as an audio device to transmit sound to the subject. The input transducer assembly 20 can be removed by the user u, and may comprise a sound inhibiting structure 50 which may be configured to inhibit feedback resulting from sound transmission from the output transducer assembly 100 to the microphone 22. The input transducer assembly 20 comprising the sound inhibiting structure 50 can be removed from the ear canal EC such that the output transducer assembly 100 remains in the ear canal, which can allow the sound inhibiting structure 50 to be cleaned when the output transducer assembly 100 remains in the ear canal or middle ear, for example. Alternatively, the output transducer assembly 100 may comprise the sound inhibiting structure 50. The input transducer assembly 20 may comprise a completely in the ear canal (hereinafter CIC) input transducer assembly. Alternatively, one or more components of input transducer assembly 20 can be placed outside the ear canal when in use. The hearing system 10 and the input transducer assembly 20 in particular may comprise any of the ear tip apparatuses described in U.S. patent application Ser. No. 14/554,606, filed Nov. 26, 2014, the contents of which are fully incorporated herein by reference.

The output transducer assembly 100 can be configured to reside in and couple to one or more structures of the ear when input transducer assembly 20 has been removed from the ear canal EC. In many embodiments, the output transducer assembly 100 is configured to reside in the ear canal EC and couple to the middle ear ME. The ear comprises an external ear, a middle ear ME and an inner ear. The external ear comprises a Pinna P and an ear canal EC and is bounded medially by an eardrum TM. Ear canal EC extends medially from pinna P to eardrum TM. Ear canal EC is at least partially defined by a skin SK disposed along the surface of the ear canal. The eardrum TM comprises an annulus TMA that extends circumferentially around a majority of the eardrum to hold the eardrum in place. The middle ear ME is disposed between eardrum TM of the ear and a cochlea CO of the ear. The middle ear ME comprises the ossicles OS to couple the eardrum TM to cochlea CO. The ossicles OS comprise an incus IN, a malleus ML and a stapes ST. The malleus ML is connected to the eardrum TM and the stapes ST is connected to an oval window OW, with the incus IN disposed between the malleus ML and stapes ST. Stapes ST is coupled to the oval window OW so as to conduct sound from the middle ear ME and the stapes ST to the cochlea CO. The round window RW of the cochlea CO is situated below the oval window OW and separated by the promontory PR. The round window RW additionally allows sound to conduct to the middle ear ML to the cochlea CO. The output transducer assembly 100 can be configured to reside in the middle ear of the user and couple to the input transducer assembly 20 placed in the ear canal EC, for example.

The input transducer assembly 20 can receive a sound input, for example an audio sound. With hearing aids for hearing impaired individuals, the input can be ambient sound. The input transducer assembly 20 comprises at least one input transducer 30, for example a microphone 32. Microphone 32 is shown positioned to detect spatial localization cues from the ambient sound, such that the user can determine where a speaker is located based on the transmitted sound. The pinna P of the ear can diffract sound waves toward the ear canal opening such that sound localization cues can be detected with frequencies above at least about 4 kHz. The sound localization cues can be detected when the microphone is positioned within ear canal EC and also when the microphone is positioned outside the ear canal EC and within about 15 mm of the ear canal opening, for example within about 5 mm of the ear canal opening. The at least one input transducer 30 may comprise one or more input transducers in addition or alternatively to microphone 32.

The input transducer assembly 20 comprises electronic components mounted on a printed circuit board (hereinafter "PCB") assembly 80. In some embodiments, the input may comprise an electronic sound signal from a sound producing or receiving device, such as a telephone, a cellular telephone, a Bluetooth connection, a radio, a digital audio unit, and the like. The electronic components mounted on the PCB of PCB assembly 80 may comprise microphone 32, a signal output transducer 40 such as a light source 42, an input amplifier 82, a sound processor 85, an output amplifier 86, a battery 88, and wireless communication circuitry 89. The signal output transducer 40 may comprise light source 42 or alternatively may comprise an electromagnet such as a coil of wire to generate a magnetic field, for example. The light source 42 may comprise an LED or a laser diode, for example. A transmission element 44 can be coupled to the signal output transducer and may comprise one or more of a ferromagnetic material or an optically transmissive material. The transmission element 44 may comprise a rod of ferrite material to deliver electromagnetic energy to a magnet of the output transducer assembly 100, for example. Alternatively, transmission element 44 may comprise an optical transmission element such as a window, a lens or an optical fiber. The optical transmission element can be configured to transmit optical electromagnetic energy comprising one or more of infrared light energy, visible light energy, or ultraviolet light energy, for example.

The signal output transducer 40 can produce an output such as electromagnetic energy EM based on the sound input, so as to drive the output transducer assembly 100. Output transducer assembly 100 can receive the output from input transducer assembly 20 and can produce mechanical vibrations in response. Output transducer assembly 100 comprises a sound transducer and may comprise at least one of a coil, a magnet, a magnetostrictive element, a photostrictive element, or a piezoelectric element, for example. For example, the output transducer assembly 100 can be coupled input transducer assembly 20 comprising an elongate flexible support having a coil supported thereon for insertion into the ear canal. Alternatively or in combination, the input transducer assembly 20 may comprise a light source coupled to a fiber optic. The light source of the input transducer assembly 20 may also be positioned in the ear canal, and the output transducer assembly and the BTE circuitry components may be located within the ear canal so as to fit within the ear canal. When properly coupled to the subject's hearing transduction pathway, the mechanical vibrations caused by output transducer assembly 100 can induce neural impulses in the subject, which can be interpreted by the subject as the original sound input.

In many embodiments, the sound inhibiting structure 50 may be located on the input transducer assembly 20 so as to inhibit sound transmission from the output transducer assembly 100 to the microphone 32 and to transmit sound from the ear canal opening to the eardrum TM, such that the user can hear natural sound. The sound inhibiting structure 50 may comprise a channel 54 coupled a source of acoustic resistance such as acoustic resistor 52. The acoustic resistor can be located at one or more of many locations to inhibit feedback and transmit sound to the eardrum. For example, in those embodiments where support 25 has a shell or a housing, the acoustic resistor 52 can be located on the distal end of such shell of the support 25. Alternatively, the acoustic resistor 52 can be located on the proximal end of shell of the support 25. The acoustic resistor 52 may comprise a known commercially available acoustic resistor or a plurality of openings formed on the shell of the support 25 and having a suitable size and number so as to inhibit feedback and transmit sound from the ear canal opening to the eardrum TM. In some embodiments, a second acoustic resistor 56 can be provided and coupled to the channel 54 away from the acoustic resistor 52. The second acoustic resistor 56 can be combined with the resistor 52 to inhibit sound at frequencies corresponding to feedback and to transmit high frequency localization cues from the ear canal to the tympanic membrane, for example.

Figure 1B:
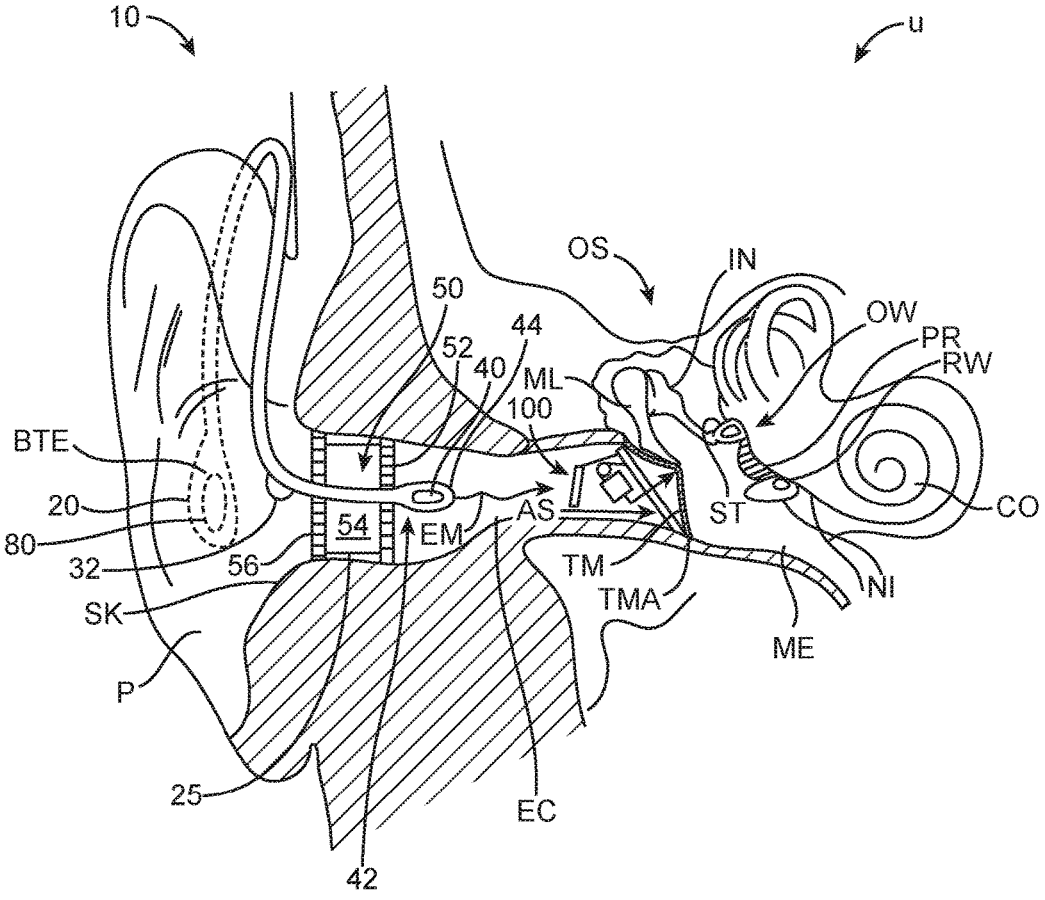
FIG. 1B shows an example of a hearing system comprising a user removable input transducer assembly having a behind the ear (hereinafter "BTE") unit configured to transmit electromagnetic energy to an output transducer assembly, in accordance with various embodiments.

FIG. 1B shows an example of hearing system 10 comprising user removable input transducer assembly 20 having a behind the ear (hereinafter "BTE") unit configured with the sound inhibiting structure 50 as described herein. The sound inhibiting structure 50 is shown placed in ear canal EC between microphone 32 and output transducer assembly 100. The support 25 may be coupled to the first acoustic resistor 52 and the second acoustic resistor 56 with chamber 54 located therebetween. The support 25 may comprise a shell component configured to conform to the ear canal EC of the user. Alternatively or in combination, support 25 may comprise an elongate portion to place the electromagnetic output transducer 40 near output transducer assembly, so as to couple the electromagnetic output transducer 40 with the output transducer assembly 100. The acoustic resistance of the acoustic resistor 52 combined with the volume and cross sectional size of channel 54 can provide sound transmission from the ear canal opening to the eardrum TM, and can provide inhibition of feedback with attenuation of sound from the eardrum to the ear canal opening. The second resistor and second channel, as described herein, can be combined with acoustic resistor 52 and channel 54 to provide the transmission of high frequency localization cues and attenuation of sound capable of causing feedback when transmitted from the eardrum TM to the microphone 32.

The input transducer assembly 20 may comprise external components for placement outside the ear canal such as the components of the printed circuit board assembly 80 as described herein. Many of the components of the printed circuit board assembly 80 can be located in the BTE unit, for example the battery 88, the sound processor 85, the output amplifier 86 and the output light source 42 may be placed in the BTE unit. In some embodiments, the battery 88 is located in the BTE unit and the other components of PCB assembly 80 are located on the PCB housed within the shell of the support 25 placed in the ear canal. For example, the microphone 32, the input amplifier 82, the sound processor 85 and the output amplifier 86 may be placed in shell of the support 25 placed in the ear canal and the battery 88 placed in the BTE unit.

The BTE unit may comprise many components of system 10 such as a speech processor, battery, wireless transmission circuitry and input transducer assembly 10. The input transducer assembly 20 can be located at least partially behind the pinna P, although the input transducer assembly may be located at many sites. For example, the input transducer assembly may be located substantially within the ear canal. The input transducer assembly may comprise a blue tooth connection to couple to a cell phone and my comprise, for example, components of the commercially available Sound ID 300, available from Sound ID of Palo Alto, Calif. The output transducer assembly 100 may comprise components to receive the light energy and vibrate the eardrum in response to light energy.

In many embodiments, support 25 can be provided without the shell as described herein, and the support 25 may comprise one or more spacers configured to engage the wall of the ear canal EC and place an elongate portion of the support near a central axis of the ear canal EC. The one or more spacers of support 25 may comprise an acoustic resistance to transmit sound localization cues and inhibit feedback. The one or more spacers may comprise first resistor 52 and second resistor 56, in which canal 54 comprises a portion of the ear canal EC extending therebetween. Alternatively, the one or more spacers may comprise a single spacer containing acoustic resistor 52 and configured for placement in the ear canal to position the elongate portion of support 25 near the central axis of the ear canal. When the elongate support is placed near the central axis of the ear canal, one or more of the electromagnetic output transducer or the transmission element may be located near the central axis of the ear canal to position the one or more of the electromagnetic output transducer or the transmission element 44 to deliver power and signal to the output transducer assembly 100.

Figure 2A:
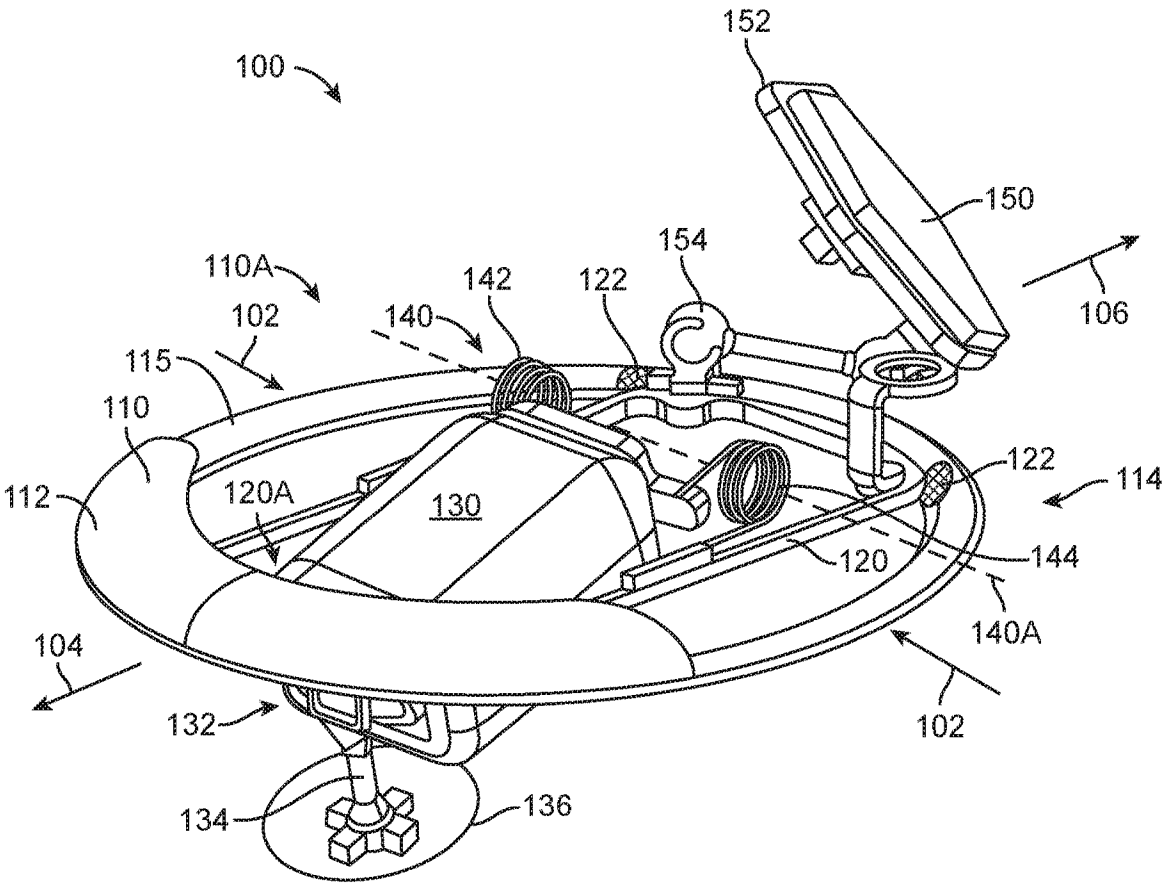
FIGS. 2A and 2B show isometric and top views, respectively, of examples of the output transducer assembly, in accordance with some embodiments.
Figure 2B:
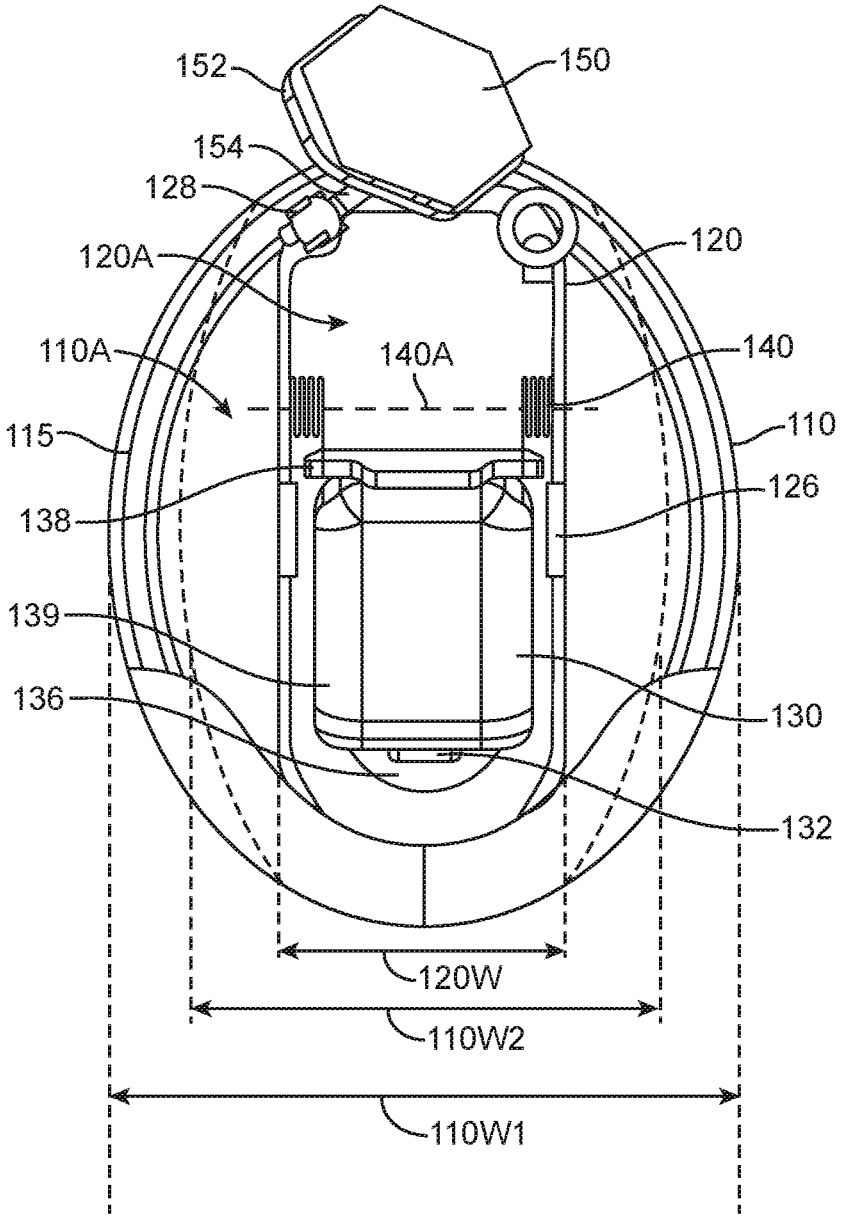

FIGS. 2A and 2B show isometric and top views, respectively, of an example of the output transducer assembly 100. The output transducer assembly 100 can be configured in many ways and may comprise one or more of a magnet, a magnetic material, a photo transducer, a photomechanical transducer, a photostrictive transducer, a photovoltaic transducer, or a photodiode, for example. The output transducer assembly may comprise a magnet on an elastomeric support configured to be placed on the eardrum and coupled to the eardrum with a fluid, for example. Alternatively, the output transducer assembly may comprise a photomechanical transducer on an elastomeric support configured to be placed on the eardrum. The output transducer assembly may be configured for placement in the middle ear, for example with attachment to one or more ossicles. In many embodiments, output transducer assembly 100 comprises a retention structure 110, a support 120, a transducer 130, at least one spring 140 and a photodetector 150. Retention structure 110 is sized to couple to the eardrum annulus TMA and at least a portion of the anterior sulcus AS of the ear canal EC. Retention structure 110 comprises an aperture 110A. Aperture 110A is sized to receive transducer 130.

The retention structure 110 can be sized to the user and may comprise one or more of an o-ring, a c-ring, a molded structure, or a structure having a shape profile so as to correspond to a mold of the ear of the user. For example retention structure 110 may comprise a polymer layer 115 coated on a positive mold of a user, such as an elastomer or other polymer. Alternatively or in combination, retention structure 110 may comprise a layer 115 of material formed with vapor deposition on a positive mold of the user, as described herein. Retention structure 110 may comprise a resilient retention structure such that the retention structure can be compressed radially inward as indicated by arrows 102 from an expanded wide profile configuration to a narrow profile configuration when passing through the ear canal and subsequently expand to the wide profile configuration when placed on one or more of the eardrum, the eardrum annulus, or the skin of the ear canal.

The retention structure 110 may comprise a shape profile corresponding to anatomical structures that define the ear canal. For example, the retention structure 110 may comprise a first end 112 corresponding to a shape profile of the anterior sulcus AS of the ear canal and the anterior portion of the eardrum annulus TMA. The first end 112 may comprise an end portion having a convex shape profile, for example a nose, so as to fit the anterior sulcus and so as to facilitate advancement of the first end 112 into the anterior sulcus. The retention structure 110 may comprise a second end 114 having a shape profile corresponding to the posterior portion of eardrum annulus TMA.

The support 120 may comprise a frame, or chassis, so as to support the components connected to support 120. Support 120 may comprise a rigid material and can be coupled to the retention structure 110, the transducer 130, the at least one spring 140 and the photodetector 150. The support 120 may comprise a biocompatible metal such as stainless steel so as to support the retention structure 110, the transducer 130, the at least one spring 140 and the photodetector 150. For example, support 120 may comprise cut sheet metal material. Alternatively, support 120 may comprise injection molded biocompatible plastic. The support 120 may comprise an elastomeric bumper structure 122 extending between the support and the retention structure, so as to couple the support to the retention structure with the elastomeric bumper. The elastomeric bumper structure 122 can also extend between the support 120 and the eardrum, such that the elastomeric bumper structure 122 contacts the eardrum TM and protects the eardrum TM from the rigid support 120. The support 120 may define an aperture 120A formed thereon. The aperture 120A can be sized so as to receive the balanced armature transducer 130, for example such that the housing of the balanced armature transducer 130 can extend at least partially through the aperture 120A when the balanced armature transducer is coupled to the eardrum TM. The support 120 may comprise an elongate dimension such that support 120 can be passed through the ear canal EC without substantial deformation when advanced along an axis corresponding to the elongate dimension, such that support 120 may comprise a substantially rigid material and thickness.

The transducer 130 comprises structures to couple to the eardrum when the retention structure 120 contacts one or more of the eardrum, the eardrum annulus, or the skin of the ear canal. The transducer 130 may comprise a balanced armature transducer having a housing and a vibratory reed 132 extending through the housing of the transducer. The vibratory reed 132 is affixed to an extension 134, for example a post, and an inner soft coupling structure 136. The soft coupling structure 136 has a convex surface that contacts the eardrum TM and vibrates the eardrum TM. The soft coupling structure 136 may comprise an elastomer such as silicone elastomer. The soft coupling structure 136 can be anatomically customized to the anatomy of the ear of the user. For example, the soft coupling structure 136 can be customized based a shape profile of the ear of the user, such as from a mold of the ear of the user as described herein.

At least one spring 140 can be connected to the support 120 and the transducer 130, so as to support the transducer 130. The at least one spring 140 may comprise a first spring 122 and a second spring 124, in which each spring is connected to opposing sides of a first end of transducer 130. The springs may comprise coil springs having a first end attached to support 120 and a second end attached to a housing of transducer 130 or a mount affixed to the housing of the transducer 130, such that the coil springs pivot the transducer about axes 140A of the coils of the coil springs and resiliently urge the transducer toward the eardrum when the retention structure contacts one or more of the eardrum, the eardrum annulus, or the skin of the ear canal. The support 120 may comprise a tube sized to receiving an end of the at least one spring 140, so as to couple the at least one spring to support 120.

A photodetector 150 can be coupled to the support 120. A bracket mount 152 can extend substantially around photodetector 150. An arm 154 may extend between support 120 and bracket 152 so as to support photodetector 150 with an orientation relative to support 120 when placed in the ear canal EC. The arm 154 may comprise a ball portion so as to couple to support 120 with a ball-joint. The photodetector 150 can be coupled to transducer 130 so as to driven transducer 130 with electrical energy in response to the light energy signal from the output transducer assembly.

Resilient retention structure 110 can be resiliently deformed when inserted into the ear canal EC. The retention structure 110 can be compressed radially inward along the pivot axes 140A of the coil springs such that the retention structure 110 is compressed as indicated by arrows 102 from a wide profile configuration having a first width 110W1 to an elongate narrow profile configuration having a second width 110W2 when advanced along the ear canal EC as indicated by arrow 104 and when removed from the ear canal as indicated by arrow 106. The elongate narrow profile configuration may comprise an elongate dimension extending along an elongate axis corresponding to an elongate dimension of support 120 and aperture 120A. The elongate narrow profile configuration may comprise a shorter dimension corresponding to a width 120W of the support 120 and aperture 120A along a shorter dimension. The retention structure 110 and support 120 can be passed through the ear canal EC for placement. The reed 132 of the balanced armature transducer 130 can be aligned substantially with the ear canal EC when the assembly 100 is advanced along the ear canal EC in the elongate narrow profile configuration having second width 110W2.

The support 120 may comprise a rigidity greater than the resilient retention structure 110, such that the width 120W remains substantially fixed when the resilient retention structure is compressed from the first configuration having width 110W1 to the second configuration having width 110W2. The rigidity of support 120 greater than the resilient retention structure 110 can provide an intended amount of force to the eardrum TM when the inner soft coupling structure 136 couples to the eardrum, as the support 120 can maintain a substantially fixed shape with coupling of the at least one spring 140. In many embodiments, the outer edges of the resilient retention structure 110 can be rolled upwards toward the side of the photodetector 150 so as to compress the resilient retention structure from the first configuration having width 110W1 to the second configuration having width 110W2, such that the assembly can be easily advanced along the ear canal EC.

Figure 3A:
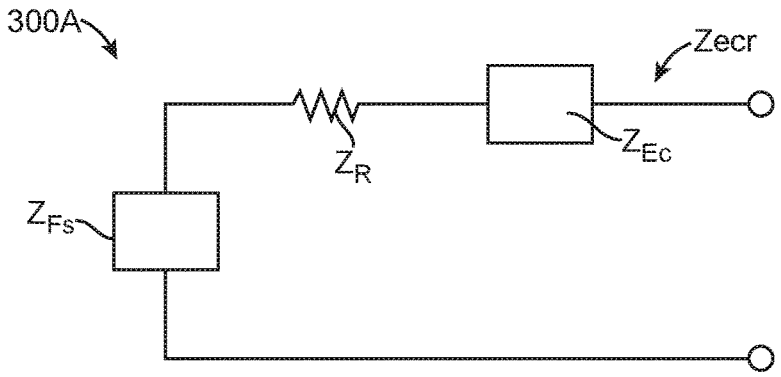
FIG. 3A shows an example of a schematic model of acoustic impedance from the eardrum to outside the ear canal, in accordance with various embodiments.

FIG. 3A shows a schematic model of acoustic impedance from the eardrum to outside the ear canal. The impedance from the eardrum to outside the ear canal in reverse may comprise an impedance from the canal (hereinafter "Zecr"), an impedance of free space (hereinafter "Zfs") and a resistance from the one or more acoustic resistors coupled to a chamber as described herein (hereinafter "ZR"). The reverse canal impedance Zecr may comprise an impedance of the ear canal EC (hereinafter "$Z_{EC}$)" and an impedance of the channel 54, for example.

Figure 3B:
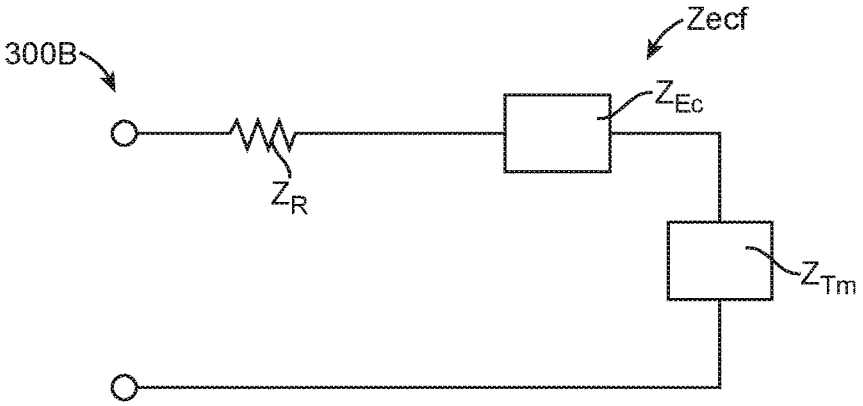
FIG. 3B shows an example of a schematic model of acoustic impedance from the outside the ear canal to the eardrum, in accordance with various embodiments.

FIG. 3B shows a schematic model of forward acoustic impedance from the outside the ear canal to the eardrum. The impedance from outside the ear canal to the eardrum may comprise an impedance looking forward through the canal (hereinafter "Zecf"), an impedance of the tympanic membrane (hereinafter "ZTM"), and a resistance from the one or more acoustic resistors as described herein (ZR). The forward canal impedance Zecf may comprise an impedance of the ear canal EC ($Z_{EC}$) and an impedance of one or more channels such as the channel 54, for example.

The impedance for sound along the sound path from the entrance to the ear canal where the microphone is located can be different than the impedance for sound along the feedback path from the tympanic membrane to the opening of the ear canal, so as to inhibit feedback and allow sound comprising high frequency localization cues to travel from the ear canal opening to the tympanic membrane, for at least some frequencies of sound comprising high frequency localization cues.

According to further aspects of the present disclosure, methods are provided for reducing feedback generating by a hearing apparatus configured to be placed in an ear canal of a user, including methods for determining the proper positioning and configuration of the sound inhibiting structure. The hearing apparatus may have one or more channels to provide an open ear canal from an ear canal opening to a tympanic membrane of the patient thereby reducing occlusion. A characteristic impedance of the hearing apparatus may be determined based on a position of the hearing apparatus when placed in the ear canal. A damper value may be determined based on the characteristic impedance. Using the methodology of the present disclosure, a determination may be made, for example, as to particular positioning of the sound inhibiting structure with the determined damper value (e.g., positioning within one or more channels of the hearing apparatus) to provide a predetermined amount of sound attenuation along the ear canal sufficient to inhibit feedback while allowing user audible high frequency localization cues to be transmitted toward the tympanic membrane. The new and novel methodology and devices of the present disclosure allow, for example, using acoustic dampers in an ear tip that are designed to attenuate feedback pressure to increase the maximum stable gain while transmitting sounds from the environment to the eardrum.

The characteristic impedance of the hearing system may be determined from the hearing system without the sound inhibiting structure coupled to the one or more channels of the hearing apparatus. The characteristic impedance of the hearing apparatus may be determined based on one or more of a density of air, a speed of sound, or a cross-sectional area of a location of the ear canal where the hearing apparatus is configured to be placed. The determination of the characteristic impedance of the hearing apparatus is further described herein and below.

The damper value may be determined based on a predetermined maximum stable gain of the hearing apparatus without the sound inhibiting structure coupled to the one or more channels of the hearing apparatus. The determination of the damper value is further described herein and below.

To couple the sound inhibiting structure to the one or more channels of the hearing apparatus, the sound inhibiting structure may be positioned within the one or more channels to be located at a predetermined position in the ear canal to provide the predetermined amount of sound attenuation. The one or more channels and the coupled sound inhibiting structure may combine to provide the predetermined amount of sound attenuation. The predetermined amount of sound attenuation may comprise a first frequency response profile of sound transmitted along the ear canal from the ear canal opening to the tympanic membrane and a second frequency response profile of sound transmitted along the ear canal from the tympanic membrane to the ear canal opening. The first frequency response profile may be different from the second frequency response profile.

In some embodiments, a plurality of sound inhibiting structures may be coupled to the one or more channels. The damper value may comprise a combined damper value for the plurality of sound inhibiting structures.

An impedance of the sound inhibiting structure may attenuate sound originating from the tympanic membrane toward an ear canal entrance of the user more than sound from originating from the ear canal entrance toward the tympanic membrane.

The sound inhibiting structure and the one or more channels when coupled may comprise a resonance frequency when the hearing apparatus is placed in the ear canal. The resonance frequency may be above a resonance frequency of the ear canal to transmit the high frequency localization cues and inhibit feedback.

The acoustic resistance of the acoustic resistors may be configured in many ways as described herein to inhibit feedback along the feedback path and allow audible transmission of high frequency localization cues. For example, the acoustic resistance may correspond no more than 10 dB of attenuation, so as to inhibit feedback and allow transmission of high frequency localization cues to the eardrum TM of the user. The amount of attenuation can be within a range from about 1 dB to about 30 dB, and can be frequency dependent. For example, the sound attenuation for low frequency sound can be greater than the sound attenuation for high frequency sound which may comprise localization cues. The amount of attenuation can be about 1, 2, 3, 4, 5, 6, 7, 8, 9, 10, 11, 12, 13, 14, or 15 dB, for example; and the range can be between any two of these amounts, for example a range from 5 to 10 dB. A person of ordinary skill in the art can determine the amount of attenuation and transmission based on the teachings described herein.

The damper value of the acoustic resistor(s) or damper(s) can be optimally chosen based on one or more of the measurement of feedback pressure and the determination of the maximum stable gain ("MSG") of the system without the damper(s). The characteristic impedance Zo of the ear canal can be expressed as rho*c/A, where rho is the density of air, c is the speed of sound, and A is the ear canal area in the ear tip region (for example, the cross-sectional area of the ear canal where the input transducer assembly 20 has been placed). The acoustic damper value can be chosen to be proportional to Zo and the proportionality factor may depend on the amount of desired increase in MSG given the hearing loss profile of the ear.

Figure 4:
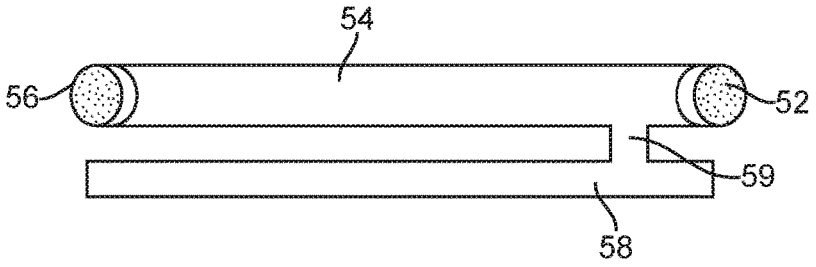
FIG. 4 shows an example of a schematic of a second channel 58 coupled to first channel 54, in order to tune the sound transmission properties from the eardrum toward the opening of the ear canal and from the ear canal opening toward the ear drum, in accordance with various embodiments.

FIG. 4 shows a second channel 58 coupled to first channel 54, in order to tune the sound transmission properties from the eardrum toward the opening of the ear canal and from the ear canal opening toward the ear drum. The second channel 58 can be coupled to the first channel 54 with an opening 59 extending between the two channels. The second channel 58 may extend a substantial distance along the ear canal adjacent the first channel 54 from a proximal end of the shell of the support 25 to a distal end of the shell of the support 25. The opening 59 can be located near the acoustic resistor 52. Alternatively, the opening 59 can be located away from the acoustic resistor 52, for example near a middle portion of the first channel 54. The second channel 58 may comprise a first acoustic resistor 52 and a second acoustic resistor 56.

Figure 5:
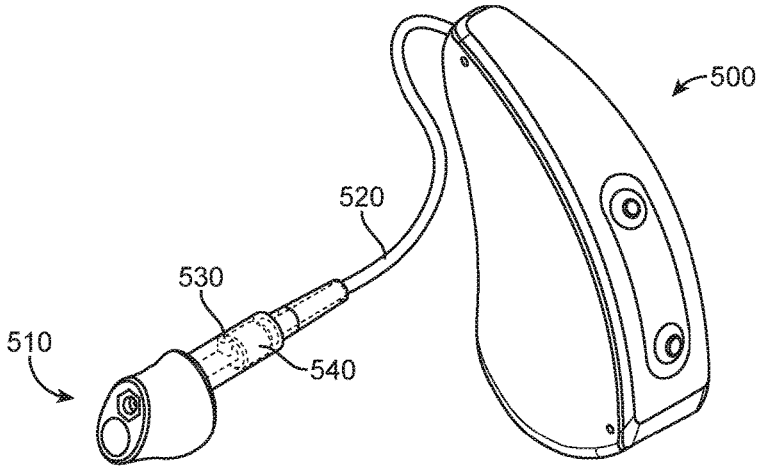
FIG. 5 shows an isometric view of an example of a behind-the-ear (BTE) assembly with a light source in the ear tip and a microphone located in the ear tube cable, in accordance with some embodiments.

FIG. 5 shows an example of a BTE hearing unit 500 coupled to an input transducer assembly or ear tip 510 configured to be placed in an ear canal. The BTE hearing unit 500 may be coupled to the ear tip 510 through an ear tube cable 520. The ear tip 510 is shown to have an opening 530, which may house the ear acoustic resistor, also referred to as the acoustic damper. The microphone 540 may be disposed in various locations, for example, at a location near the ear canal entrance with the ear tip 510 placed in the ear canal. The microphone 540 may be disposed within the ear tube cable 520.

Figure 6A:
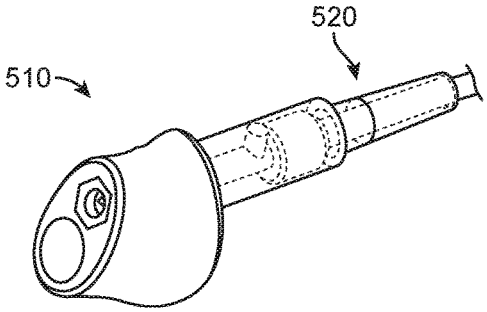
FIGS. 6A and 6B show isometric views (medial to lateral and lateral to medial, respectively) of the ear tip of FIG. 5, in accordance with embodiments.
Figure 6B:
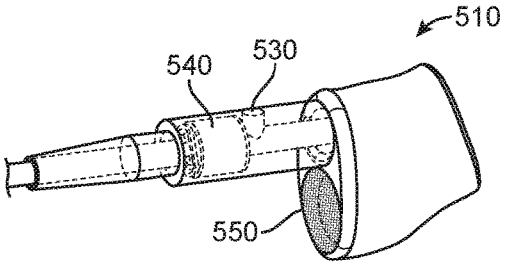

FIG. 6A shows a close up of the ear tip 510 as viewed from the lateral to medial direction while FIG. 6B shows the same tip 510 as viewed from the medial to lateral direction which more clearly shows the acoustic resistor 550. Also shown in FIG. 6A is the microphone port and the microphone located within the ear tube cable.

Figure 7A:
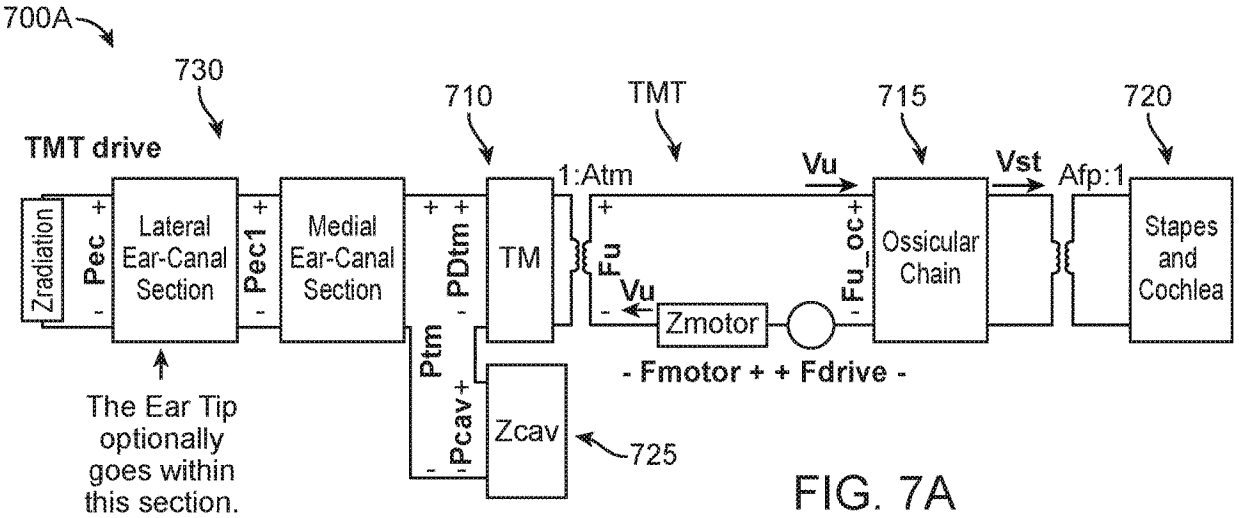
FIG. 7A shows an example of a schematic of a model simulating the middle ear driven by the force generated by a transducer at the umbo, in accordance with embodiments.
Figure 7B:
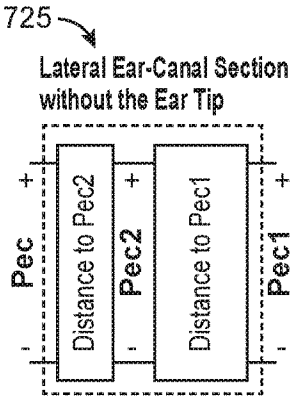
FIG. 7B shows an example of a schematic of a model simulating the ear canal without an ear tip.
Figure 7C:
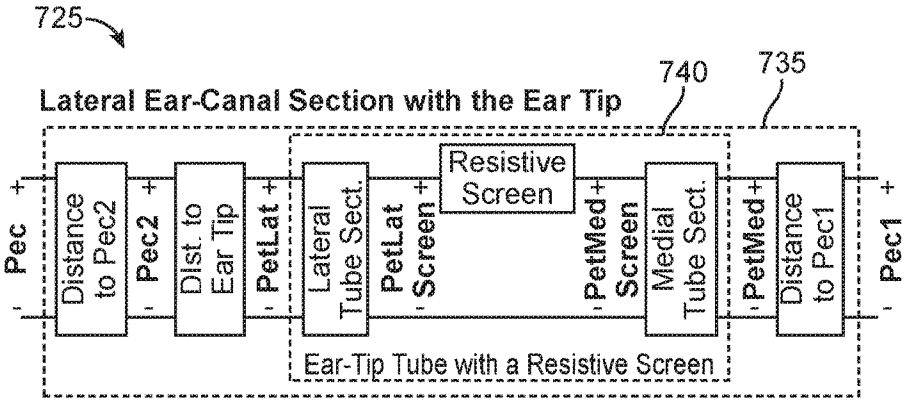
FIG. 7C shows an example of a schematic of a model simulating the placement of an ear tip tube with a resistive screen or damper and its effect on feedback pressure from the eardrum Pec1 to the lateral portion of the ear canal Pec, in accordance with various embodiments.

FIG. 7A shows a block diagram 700A of the middle ear comprising the tympanic membrane 710, ossicular chain 715, cochlear load 720, middle ear cavity 725, and ear canal 730. The output transducer TMT may drive the umbo of the eardrum with force Fdrive and impedance Zmotor. FIG. 7B shows a block diagram 700B representing the normal open ear canal 725 without an ear tip. FIG. 7C shows a block diagram 700C of the ear canal 725 with an ear tip 735 and a feedback reduction structure, such as a resistive screen or damper 740, in a specific location, and its effect on feedback pressure from the eardrum Pec1 to the lateral portion of the ear canal Pec.

Figure 8:
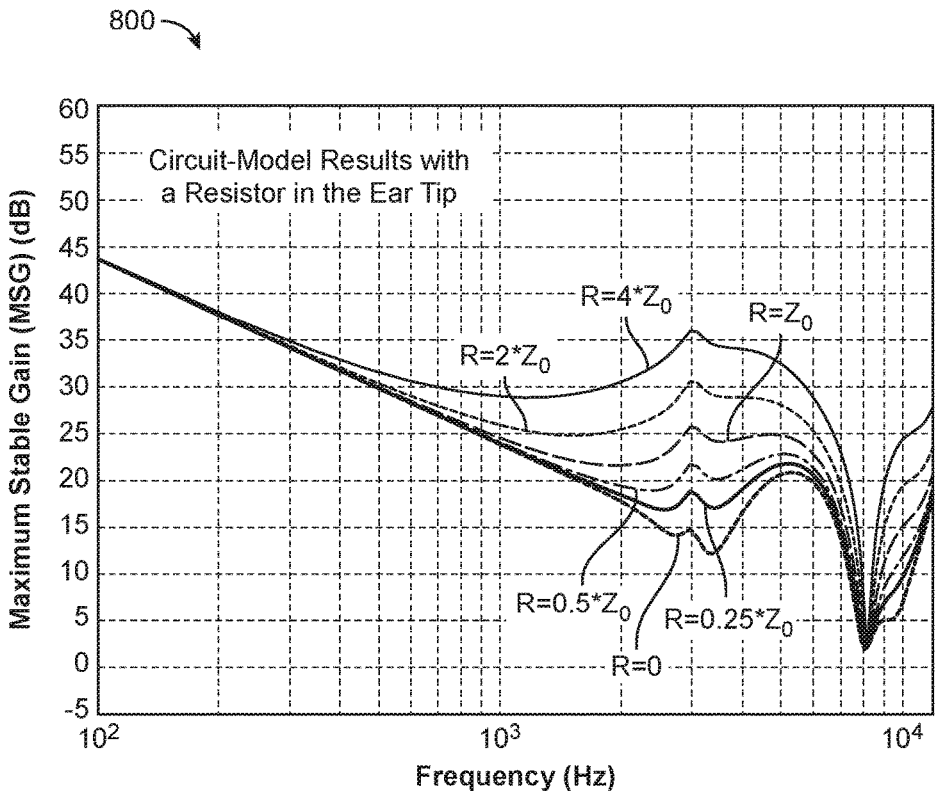
FIG. 8 shows an example of a graph of model calculations demonstrating that increasing values of acoustic dampening R in the ear canal tip can increase the maximum stable gain (MSG), wherein the amount of improvement in MSG may be proportional to the amount of acoustic dampening (R) and the characteristic impedance of the ear canal is Zo and values of R can be uniquely chosen to be proportional to Zo, in accordance with various embodiments.

FIG. 8 shows an example of a chart 800 of the maximum stable gain (MSG, in dB) plotted as a function of frequency (in Hz), calculated using, for example, the model of FIGS. 7A-7C. Several damping values ranging from R=0 (no screen) to R=4*Zo were simulated. FIG. 8 shows that there can be an increase in MSG with an increased damping above about 1 kHz. For example, the amount of improvement in MSG may be proportional to the amount of acoustic dampening (R) wherein the characteristic impedance of the ear canal is Zo and values of R can be uniquely chosen to be proportional to Zo. The dip in MSG near 8 kHz may be due to a standing wave in the acoustics of the cylindrical tubes used in the simulations.

One or more processors may be programmed to perform various steps and methods as described in reference to various embodiments and implementations of the present disclosure. Embodiments of the apparatus and systems of the present disclosure may be comprised of various modules, for example, as discussed above. Each of the modules can comprise various sub-routines, procedures and macros. Each of the modules may be separately compiled and linked into a single executable program.

It will be apparent that the number of steps that are utilized for such methods are not limited to those described above. Also, the methods do not require that all the described steps are present. Although the methodology described above as discrete steps, one or more steps may be added, combined or even deleted, without departing from the intended functionality of the embodiments. The steps can be performed in a different order, for example. It will also be apparent that the method described above may be performed in a partially or substantially automated fashion.

As will be appreciated by those skilled in the art, the methods of the present disclosure may be embodied, at least in part, in software and carried out in a computer system or other data processing system. Therefore, in some exemplary embodiments hardware may be used in combination with software instructions to implement the present disclosure. Any process descriptions, elements or blocks in the flow diagrams described herein and/or depicted in the attached figures should be understood as potentially representing modules, segments, or portions of code which include one or more executable instructions for implementing specific logical functions or elements in the process. Further, the functions described in one or more examples may be implemented in hardware, software, firmware, or any combination of the above. If implemented in software, the functions may be transmitted or stored on as one or more instructions or code on a computer-readable medium, these instructions may be executed by a hardware-based processing unit, such as one or more processors, including general purpose microprocessors, application specific integrated circuits, field programmable logic arrays, or other logic circuitry.

While preferred embodiments have been shown and described herein, it will be apparent to those skilled in the art that such embodiments are provided by way of example only. Numerous variations, changes, and substitutions will now occur to those skilled in the art without departing from the invention. It should be understood that various alternatives to the embodiments described herein may be employed in practicing the invention. By way of non-limiting example, it will be appreciated by those skilled in the art that particular features or characteristics described in reference to one figure or embodiment may be combined as suitable with features or characteristics described in another figure or embodiment. It is intended that the following claims define the scope of the invention and that methods and structures within the scope of these claims and their equivalents be covered thereby.

What is claimed is:

1. A method of reducing Feedback generated by a hearing apparatus configured to be placed in an ear canal of a user, the method comprising:

determining a characteristic impedance of the hearing apparatus based on a position of the hearing apparatus when placed in the ear canal;

determining a damper value based on the characteristic impedance; and determining a position of a sound inhibiting structure with the determined damper value relative to the one or more channels of the hearing apparatus to provide a predetermined amount of sound attenuation along the ear canal sufficient to inhibit feedback while allowing user audible high frequency localization cues to be transmitted toward the tympanic membrane.

2. The method of claim 1, wherein the characteristic impedance of the hearing system is determined without the sound inhibiting structure coupled to the one or more channels of the hearing apparatus.

3. The method of claim 1, wherein determining the characteristic impedance of the hearing apparatus comprises determining the characteristic impedance of the hearing system based on one or more of a density of air, a speed of sound, or a cross-sectional area of a location of the ear canal where the hearing apparatus is configured to be placed.

4. The method of claim 1, wherein determining the damper value comprises determining the damper value based on a predetermined maximum stable gain of the hearing apparatus without the sound inhibiting structure coupled to the one or more channels of the hearing apparatus.

5. The method of claim 1, further comprising positioning the sound inhibiting structure within the one or more channels at the determined position to couple the sound inhibiting structure to the one or more channels and provide the predetermined amount of sound attenuation.

6. The method of claim 5, wherein the one or more channels and the sound inhibiting structure positioned at the determined position combine to provide the predetermined amount of sound attenuation.

7. The method of claim 1, wherein the predetermined amount of sound attenuation comprises a first frequency response profile of sound transmitted along the ear canal from the ear canal opening to the tympanic membrane and a second frequency response profile of sound transmitted along the ear canal from the tympanic membrane to the ear canal opening, the first frequency response profile being different from the second frequency response profile.

8. The method of claim 1, wherein determining the position of the sound inhibiting structure relative to the one or more channels comprises determining a plurality of positions of a plurality of sound inhibiting structures relative to the one or more channels, wherein the damper value comprises a combined damper value for the plurality of sound inhibiting structures.

9. The method of claim 1, wherein an impedance of the sound inhibiting structure attenuates sound originating from the tympanic membrane toward an ear canal entrance of the user more than sound from originating from the ear canal entrance toward the tympanic membrane.

10. The method of claim 1, wherein the sound inhibiting structure and the one or more channels when coupled to one another comprise a resonance frequency when the hearing apparatus is placed in the ear canal, and wherein the resonance frequency is above a resonance frequency of the ear canal to transmit the high frequency localization cues and inhibit feedback.

* * * * *